US008505508B2

(12) United States Patent
Kameda et al.

(10) Patent No.: US 8,505,508 B2
(45) Date of Patent: Aug. 13, 2013

(54) PHASE VARYING DEVICE FOR ENGINE

(75) Inventors: Michihiro Kameda, Hadano (JP); Masayasu Nagado, Hadano (JP); Naoya Ishihara, Hadano (JP)

(73) Assignee: Nittan Valve Co., Ltd., Hadano-shi, Kanagawa (JP)

( * ) Notice: Subject to any disclaimer, the term of this patent is extended or adjusted under 35 U.S.C. 154(b) by 92 days.

(21) Appl. No.: 13/375,385

(22) PCT Filed: Jun. 5, 2009

(86) PCT No.: PCT/JP2009/060327
§ 371 (c)(1),
(2), (4) Date: Nov. 30, 2011

(87) PCT Pub. No.: WO2010/140250
PCT Pub. Date: Dec. 9, 2010

(65) Prior Publication Data

US 2012/0073532 A1 Mar. 29, 2012

(51) Int. Cl.
*F01L 1/34* (2006.01)

(52) U.S. Cl.
USPC ..... 123/90.17; 123/90.15

(58) Field of Classification Search
USPC ..... 123/90.15, 90.17
See application file for complete search history.

(56) References Cited

U.S. PATENT DOCUMENTS

| | | | | |
|---|---|---|---|---|
| 6,732,688 | B2 * | 5/2004 | Yamamuro et al. | 123/90.17 |
| 2008/0202460 | A1 | 8/2008 | Maehara et al. | |
| 2010/0313836 | A1 * | 12/2010 | Kameda et al. | 123/90.17 |
| 2011/0000450 | A1 * | 1/2011 | Shiino et al. | 123/90.17 |
| 2011/0036319 | A1 * | 2/2011 | Kameda et al. | 123/90.17 |
| 2011/0192365 | A1 * | 8/2011 | Kameda et al. | 123/90.15 |
| 2011/0226202 | A1 * | 9/2011 | Nagado | 123/90.15 |

FOREIGN PATENT DOCUMENTS

| | | | |
|---|---|---|---|
| JP | 5-118208 | A | 5/1993 |
| JP | 9-060509 | A | 3/1997 |
| JP | 10-266876 | A | 10/1998 |
| JP | 2002-364314 | A | 12/2002 |
| JP | 2003-129805 | A | 5/2003 |
| JP | 2006-077779 | A | 3/2006 |
| JP | 2008-208731 | A | 9/2008 |
| WO | 2010/026645 | A1 | 3/2010 |

OTHER PUBLICATIONS

International Search Report of PCT/JP2009/060327, mailing date Sep. 8, 2009.

* cited by examiner

*Primary Examiner* — Kenneth Bomberg
*Assistant Examiner* — Ngoc T Nguyen
(74) *Attorney, Agent, or Firm* — Westerman, Hattori, Daniels & Adrian, LLP

(57) ABSTRACT

To provide a simpler, axially shorter, and easy-to-manufacture phase varying apparatus for an automobile engine, utilizes a four-link mechanism consisting of multiple circular members. MEANS FOR ACHIEVING THE OBJECT
An inventive phase varying apparatus has: a camshaft; drive rotor driven by the crankshaft; a first and a second torque means for rotating a first and a second control rotors, all aligned coaxially and rotatable relative to each other; and a phase angle varying mechanism operably coupled to the first and second torque means, so as to varying the relative phase angle between the camshaft and the crankshaft. The phase angle varying mechanism comprises: a circular eccentric cam integral with the camshaft; a first and a second link each having a shape of a substantially cylindrical form; and a quasi-radial guide mechanism and displacement forcing means collaborating with each other for displacing either one of the first and second links in a quasi-radial direction of the rotor.

6 Claims, 18 Drawing Sheets

(a)

(b)

SECTION D - D

PHASE VARYING DEVICE FOR ENGINE

FIELD OF THE INVENTION

This invention relates to a phase varying apparatus for an automobile engine, having a four-link mechanism consisting of substantially circular members for varying the valve timing of the engine by advancing or retarding the phase angle (or simply phase) of a camshaft relative to the crankshaft or the engine.

BACKGROUND ART

A phase varying apparatus for automobile engine utilizing helical splines has been disclosed in Patent Document 1 cited below. (See for example FIGS. 1 and 2 of Patent Document 1.) The apparatus of Patent Document 1 consists of: an outer hollow cylindrical portion 10 subjected to a torque transmitted from the crankshaft; an inner hollow cylindrical portion 20 integrally connected with the camshaft; and an intermediate member 30 in engagement with helical splines (17, 32, 32, 33) provided between the outer hollow cylindrical portion 10 and inner hollow cylindrical portion 20, the intermediate member 30 having a square male screw portion 31 that engages with the female screw 45 formed inside a brake drum 41. The intermediate member 30 is moved by the square male and female screws (31 and 15) in the axial direction or the camshaft (to the right in FIG. 1) when a brake drum 44 is acted upon by a braking force exerted by an electromagnetic braking means 40, which causes the helical splines (17, 23, 32, and 33) to rotate the inner hollow cylindrical portion 20 (camshaft 2) relative to the outer hollow cylindrical portion 10 (sprocket 12). As a consequence, the phase angle of the camshaft is changed relative to the crankshaft, thereby changing the valve timing.

PATENT DOCUMENT 1 JPA Early Publication H2002-364314

DISCLOSURE OF THE INVENTION

Problems to be Solved by the Invention

The range of variable phase of the phase varying apparatus disclosed in Patent Document 1 may be extended by extending the movable range of the intermediate member 30 in the axial direction by extending the axial lengths of the inner hollow cylindrical portion 20 and helical splines (17, 23, 32, and 33). However, the axial length of the phase varying apparatus will be then necessarily increased, so that it will be difficult to use the apparatus with a small engine.

To overcome this problem, the applicant of the present invention has made an application for patent (PCT/JP2008/66082, which will be referred to as Prior Art Document 1.) on an axially shorter phase varying apparatus for use with a small engine. This prior art apparatus has a drive rotor 71 (having a sprocket 71a) driven by a crankshaft; a camshaft (or a center shaft 72 integral therewith); a first intermediate rotor 73 movable only in the radial direction of the camshaft; a first control rotor 74 for displacing the first intermediate rotor 73 in the radial direction; and a torque means. The first control rotor 74 has a circular eccentric cam 76 that is integral therewith and engages with a cam guide 77 that extends in a radial direction of the first intermediate rotor 73. The flat engagement face 72*d* of the center shaft 72 engages with an oblong rectangular hole 80 formed in the first intermediate rotor to extend in the direction perpendicular to the cam guide 77. Thus, when the first intermediate rotor 73 is slidably moved in the radial direction, the phase angle of the camshaft relative to the drive rotor is changed by the displacement of the shaft member 81 (formed on the first intermediate rotor 73) within the guide groove 79 formed in the drive rotor 71 and extending in a substantially circumferential direction with a decreasing radius.

In this phase varying mechanism, the intermediate rotor is moved in the radial direction while changing the phase. Since the variable range of phase is determined by the configuration of a guide groove formed in the circumferential direction, the axial length of the apparatus can be shortened by appropriately choosing the configuration of the guide groove.

On the other hand, the first control rotor 74 can be rotated in the opposite direction relative to the drive rotor 71 by a torque means that comprises a reverse rotation mechanism for rotating the first control rotor 74 in the direction opposite to that caused by the first electromagnetic clutch 75. This reverse rotation mechanism includes such elements as a first and a second ring member (83 and 86), second intermediate rotor 84, rod member 85, second control rotor 87, and second electromagnetic clutch 90. When the second electromagnetic clutch 90 puts a brake on the second control rotor 87, the first and second ring members (83 and 86) rotate within the circular eccentric holes (74*d* and 87*d*) of the first and second control rotors (74 and 87), respectively. The rod member 85 connecting the first and second ring members (83 and 86) together is displaced in a radial guide groove 84*b* formed to extend in a quasi-radial direction (quasi-radial direction hereinafter referred to as quasi-radial direction) in the second intermediate rotor 84, so that the reverse rotation mechanism causes the first control rotor 74 to be rotated in the reverse direction relative to the drive rotor.

Since the prior art phase varying apparatus consists of circular members that are displaceable and/or rotatable primarily in the direction perpendicular to the axis of the apparatus, the apparatus can be advantageously manufactured easily in an axially short form. In the prior art apparatus, however, the phase varying mechanism and reverse rotation mechanism are provided independently along the axis and across the first control rotor. Further, there are some members, e.g. the first and second ring members (83 and 86) and intermediate rotor 84, that are arranged along the axis in a stacking condition. The inventors of this application have found it possible to utilize the phase varying mechanism also as the reverse rotation mechanism of the first control rotor and vise versa to realize a still shorter phase varying apparatus having less elements. This can be done by forming a four-link mechanism using multiple circular members.

Thus, it is an object of the present invention to provide a phase varying mechanism having a multiplicity of circular members serving as a four-link mechanism, which is shorter in axial length and easier to manufacture than conventional ones.

Means for Carrying Out the Invention

To achieve the object above, the invention provides a phase varying apparatus for use with an automobile engine as defined in claim 1, which comprises: a camshaft; a drive rotor driven by the crankshaft of the engine; a first and a second control rotor which are rotatable relative to each other and arranged coaxially between the camshaft and drive rotor; first and second torque means for respectively providing the first and second control rotor with a torque for causing rotation relative to the drive rotor; and a phase angle varying mechanism for varying the phase angle of the camshaft relative to the drive rotor in response to the rotation of either the first or second control rotor relative to the drive rotor, the phase varying apparatus characterized in that the phase angle varying mechanism comprises:

a circular eccentric cam integral with the camshaft;

a first link in the form of a substantial cylinder which is supported by the circular eccentric cam for rotation about the cam center of the circular eccentric cam;

a second link in the form of a substantial cylinder which is rotatably supported by the first link for eccentric rotation about the first axis of the first link and supported by the first control rotor for rotation about a second axis of the second link that is offset from the rotational axis of the camshaft;

a guide mechanism extending in a quasi-radial direction (hereinafter referred to as quasi-radial guide mechanism) for keeping movable the first or second link in the quasi-radial direction of the respective rotor; and displacement forcing means for applying a force to, and displacing, the first or second link in the quasi-radial guide mechanism in the quasi-radial direction.

The circular eccentric cam integral with the camshaft and substantially cylindrical first and second links constitute a four-link mechanism via the quasi-radial guide mechanism, as described in detail below. The four nodes of this four-link mechanism consists of the rotational axis of the camshaft, cam center of the circular eccentric cam, and the axes of the first and second links.

When a torque is exerted to the first control rotor by the first torque means, the substantially cylindrical second link is rotated about the second axis of the first control rotor and eccentrically rotates about the axis of the camshaft, thereby exerting a torque to the substantially cylindrical first link and causes the substantially cylindrical first link to be eccentrically rotated about the second axis. By the torque exerted by the second link, the first link is rotated about the first axis, and exerts a torque to the circular eccentric cam, thereby causing the circular eccentric cam to be eccentrically rotated about the axis of the camshaft.

In this instance, either one of the substantially cylindrical first link and second link is displaced by the quasi-radial guide mechanism in the quasi-radial direction of the associated rotor. Thus, the four links work together as a four-link mechanism. When the second control rotor is acted upon by a torque exerted by the second torque means, the first or second link is displaced in the quasi-radial direction of the associated rotor in response to the force (referred to as displacement force) acted upon by the displacement forcing means in collaboration with the quasi-radial guide mechanism. Thus, the circular eccentric cam is put in an eccentric rotation in the direction opposite to that caused by the first torque means.

The phase angle of the camshaft relative to the drive rotor (crankshaft) is advanced in the phase advancing direction or retarded in the phase retarding direction under the action of the first torque means. Under the action of the second torque means, however, the phase angle is changed in the reverse direction as compared with the change caused by the first torque means.

(Function) The four-link mechanism doubles as a phase angle varying mechanism for varying the phase angle of the camshaft in one direction relative to the crankshaft via the first control rotor and as a reverse rotation means for reversing the rotation of the first control rotor in the opposite direction. The phase angle varying apparatus of claim 1 has less components in a simplified configuration, and thus has a short axial length.

It is noted that the circular eccentric cam and the first and second links are not slacked in the axial direction, but rather they lie in the same plane perpendicular to the rotational axis of the camshaft. It is noted that the circular eccentric cam and the first and second links operate on the same plane, so that no axial space is needed for these components to operate. Since the circular eccentric cam and the first and second links have simple circular outlines and/or inner configurations to form the four-link mechanism, they can be easily manufactured and assembled.

As defined in claim 2, the phase varying apparatus of claim 1 may be configured in such a way that the quasi-radial guide mechanism is a first link guide groove, formed in the drive rotor, for guiding the first link in the quasi-radial direction; and the drive rotor has a cylindrical portion for supporting the outer periphery of the first control rotor.

(Function) The first link guide groove is a simple, quasi-radial groove formed in the drive rotor, which can be fabricated at low cost. When either the first torque means or second torque means is enabled, the first link is guided by the first link guide guiding the opposite sides of the first link, and displaced within the first link guide groove in a quasi-radial direction of the drive rotor. As a consequence, the first and second links and the circular eccentric cam operate together as a four-link. On the other hand, when the first and second torque means are disabled, the camshaft is directly subjected to an external disturbing torque arising Worn the reactive force of a valve spring. Such external disturbing torque can give rise to an unexpected change in phase angle between the camshaft and the drive rotor (or crankshaft). To prevent this a preventive mechanism is needed.

In the mechanism defined in claim 2, when the circular eccentric cam of the camshaft is acted upon by an external disturbing torque, the torque is transmitted from the first link guide groove, via the first link guide groove and second link, to the outer periphery of the first control rotor as a force that forces the first control rotor to abut against the inner circumferential wall of the drive rotor. This abutment gives rise to a local frictional force between the outer periphery of the first control rotor and the inner circumferential wall of the drive rotor. This frictional fierce immovably locks the first control rotor and the drive rotor, and further immovably locks the second link, first link, and the circular eccentric cam, hence immovably locking the camshaft and the drive rotor. In other words, the phase angle between the camshaft and the drive rotor is kept unchanged if the camshaft is subjected to an external disturbing torque.

The phase varying apparatus for an automobile engine defined in claim 2 may be configured, as recited in claim 3, such that a bush having a circular hole and parallel cutaway portions on the opposite sides thereof is provided between the first link and the first link guide groove;

the first link is slidably inscribed in the circular hole of the bush without touching the first link guide groove; and the cutaway portions formed on the opposite sides of the bushes are guided by the first link guide groove so that the bush is displaced along the first link guide groove together with the first link.

(Function) The first link is displaced within the first link guide groove without touching it, since the cutaway portions of the opposite sides of the bush are guided by the first link guide groove. In this case, since the bush is in face contact with the first link guide groove, the contact stress acting on the first link is reduced as compared with the first link where the outer periphery of the first link is in direct planar contact with the inner wall of the first link guide groove.

The phase varying apparatus for an automobile engine as defined in claim 2 or 3 may be configured to have the first link guide groove inclined through an angle with respect to a radius of the drive rotor, as defined in claim 4.

(Function) In this configuration, the component of the force exerted by the first or second torque means to the first link, and hence to the first link guide groove, is enhanced. When the first and second torque means are disabled, the reaction of the first link guide groove acting on the first link is larger in the radial direction, so that the outer periphery of the first control rotor is pushed still harder against the cylindrical inner surface of the drive rotor.

As defined in claim 5, the phase varying apparatus defined in claim 1 may be configured such that the quasi-radial guide mechanism of claim 1 has a slide member protruding from the second link; and a slide member guide groove in the form of a groove formed in the drive rotor to extend in a quasi-radial direction for holding the slide member movably in the quasi-radial direction (the groove referred to as radial guide groove);

the positions of the center axes of the first link, second link, and of the slide member with respect to the axis L0 may be aligned with substantially the same line; and the first control rotor has a circular eccentric hole for rotatably inscribing the second link.

(Function) When the first or second torque means is enabled, the slide member provided on the second link is displaced in the slide member guide groove formed in the drive rotor in a quasi-radial direction, which in turn causes the second link to be displaced in the quasi-radial direction of the drive rotor and causes the first and second links and the circular eccentric cam to operate as a four-link system.

On the other hand, according to claim 5, when the camshaft is subjected to an external disturbing torque, the second link is subjected to a reactive force in the quasi-radial direction via the circular eccentric cam and the first link, since the slide member is held within the slide member guide groove that extends in the quasi-radial direction. This reactive force pushes the outer periphery of the second link against the inner circumferential wall of the circular eccentric hole of the first control rotor, thereby giving rise to a frictional force between the outer periphery of the second link and the inner circumferential wall of the circular eccentric hole. This local frictional force locks the camshaft unrotatable on the drive rotor, thereby maintaining the relative phase angle between the camshaft and drive rotor unchanged. In this arrangement, the local frictional force can be enhanced in a mid range of the domain of variable phase angle of the camshaft relative to the drive rotor.

Results of the Invention

According to claim 1, the present invention provides an axially short, structurally simple, and cost effective phase varying apparatus utilizing a four-link mechanism formed of substantially cylindrical members. The apparatus is suitable especially for a small engine.

The invention defined in claim 2 provides a phase varying apparatus having a self-locking mechanism that maintains the relative angular phase between the camshaft and drive rotor invariable if the camshaft is subjected to an external disturbing torque.

The inventive phase varying apparatus defined in claim 3 has good durability, since uneven wear will not take place with the first link in contact with the first link guide groove.

In the phase varying apparatus defined in claim 4, the phase angle of the camshaft relative to the drive rotor can be smoothly changed. Further, performance of the self-locking mechanism for preventing any change in phase angle due to an external disturbing torque is enhanced.

The invention defined in claim 5 provides a phase varying apparatus having a self-locking mechanism for maintaining the phase angle of the camshaft relative to the drive rotor unchanged if the camshaft is subjected to an external disturbing torque. In this arrangement, the self-locking performance can be enhanced in a mid range of the domain of variable phase angle of the camshaft relative to the drive rotor. Accordingly, if the relative phase of the camshaft is reset in the mid range of the phase domain immediately before stopping the engine, the engine can be restarted without accompanying any phase gap between the camshaft and the drive rotor, and hence without providing any control torque to the camshaft. That is, the invention provides a reliable locking mechanism capable of performing the same intermediate locking function as conventional locking mechanisms without using any special parts.

BRIEF DESCRIPTION OF THE DRAWINGS

FIG. 5(*b*) the cross section taken along Line C-C of FIG. 4; and FIG. 5(*c*) cross section taken along Line B-B of FIG. 4.

FIG. 5(*b*) the cross section taken along Line C-C of FIG. 4; and FIG. 5(*c*) cross section taken along Line B-B of FIG. 4.

FIG. 7(*b*) illustrates a first electromagnetic clutch in operation; and FIG. 7(*c*) illustrates a second electromagnetic clutch in operation.

FIG. 8(*b*) shows an external disturbing torque acting on the self-locking mechanism in the phase advancing direction.

FIG. 16(*b*) operation of the first electromagnetic clutch; and FIG. 16(*c*) the first electromagnetic clutch in operation.

NOTATIONS

Figure 1:
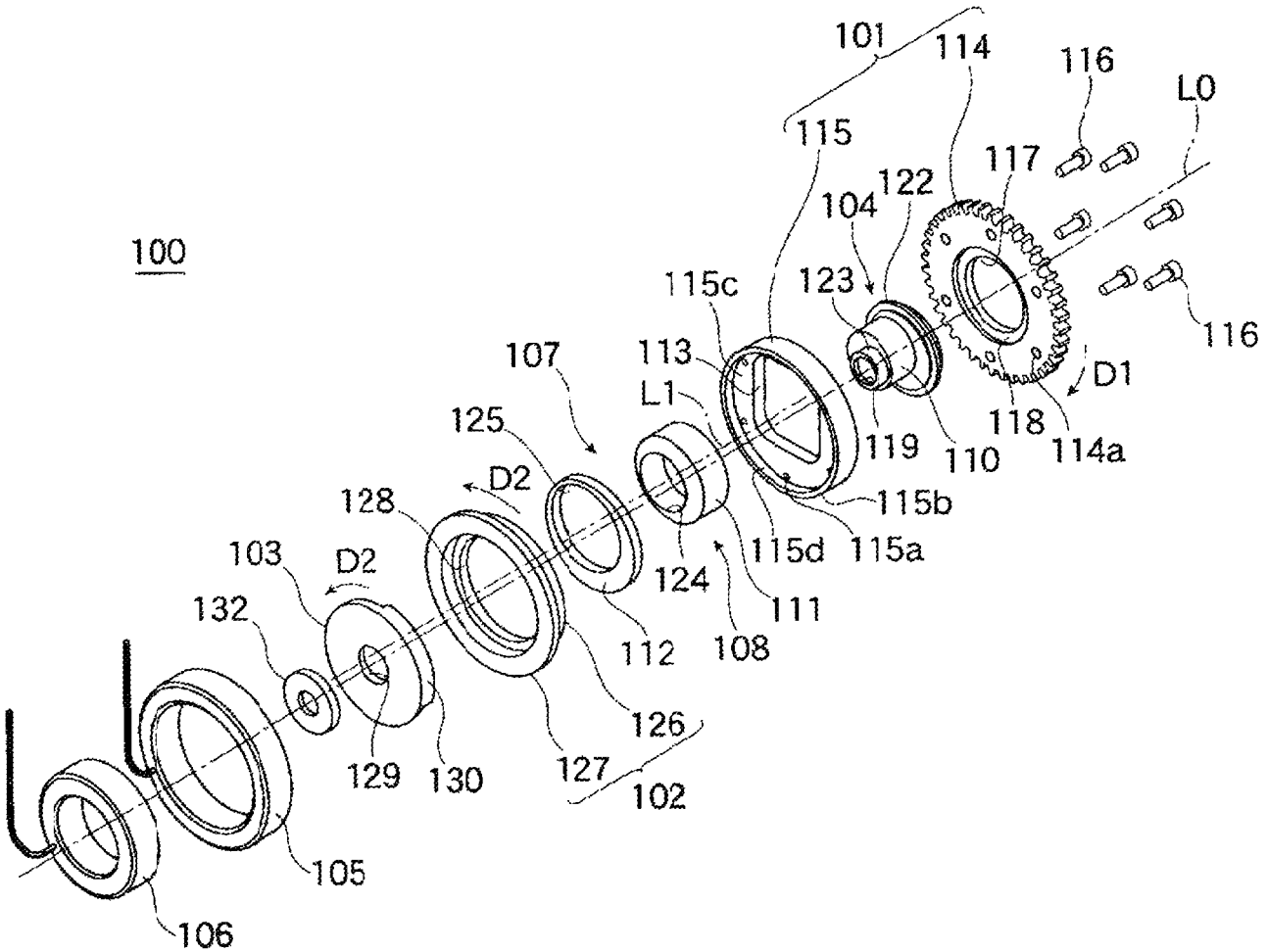
FIG. 1 is an exploded perspective view of a phase varying apparatus in accordance with a first embodiment of the invention.
Figure 2:
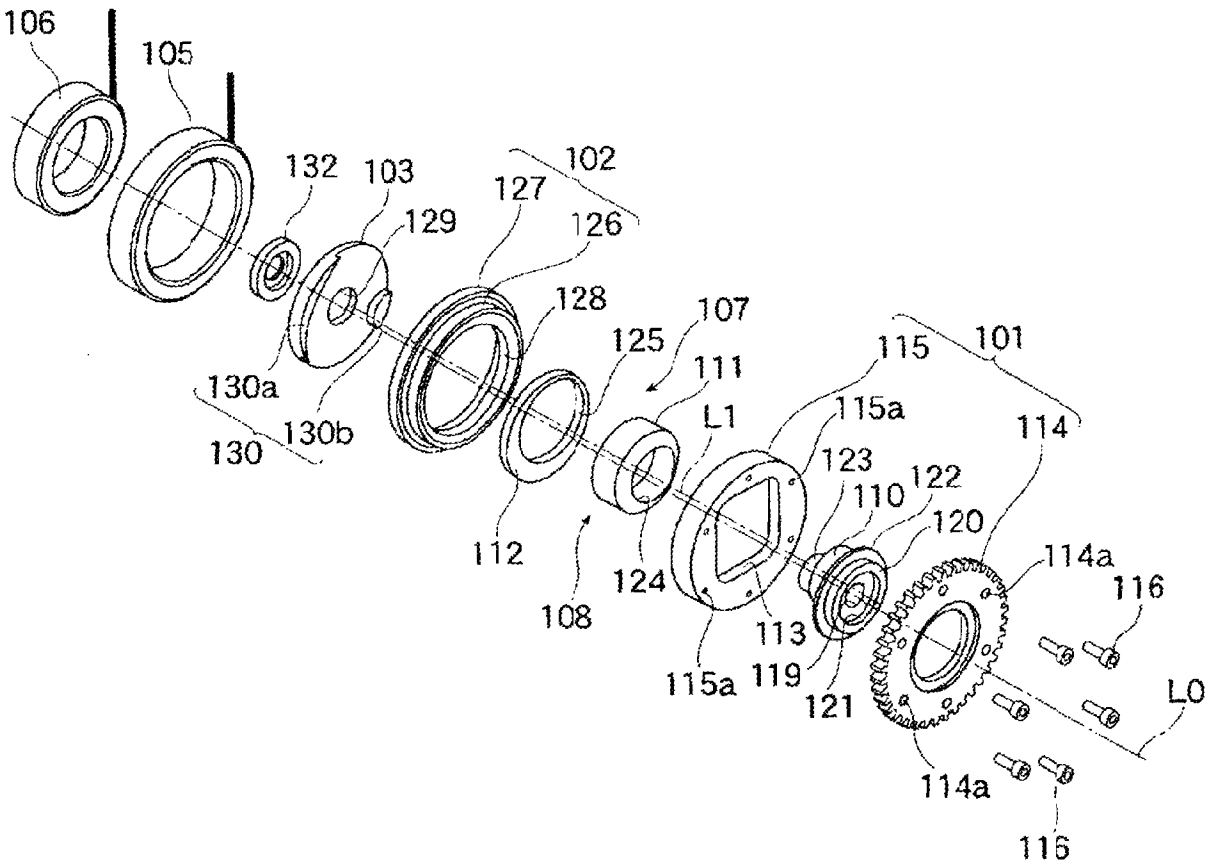
FIG. 2 is a view of the apparatus shown in FIG. 1, taken from the position of the drive rotor.
Figure 3:
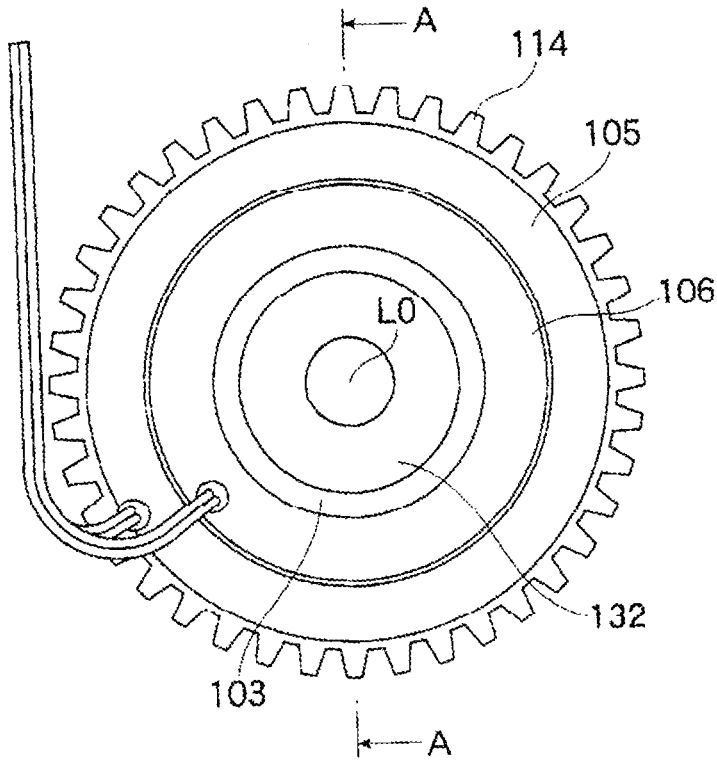
FIG. 3 is a front view of the apparatus shown in FIG. 1.
Figure 4:
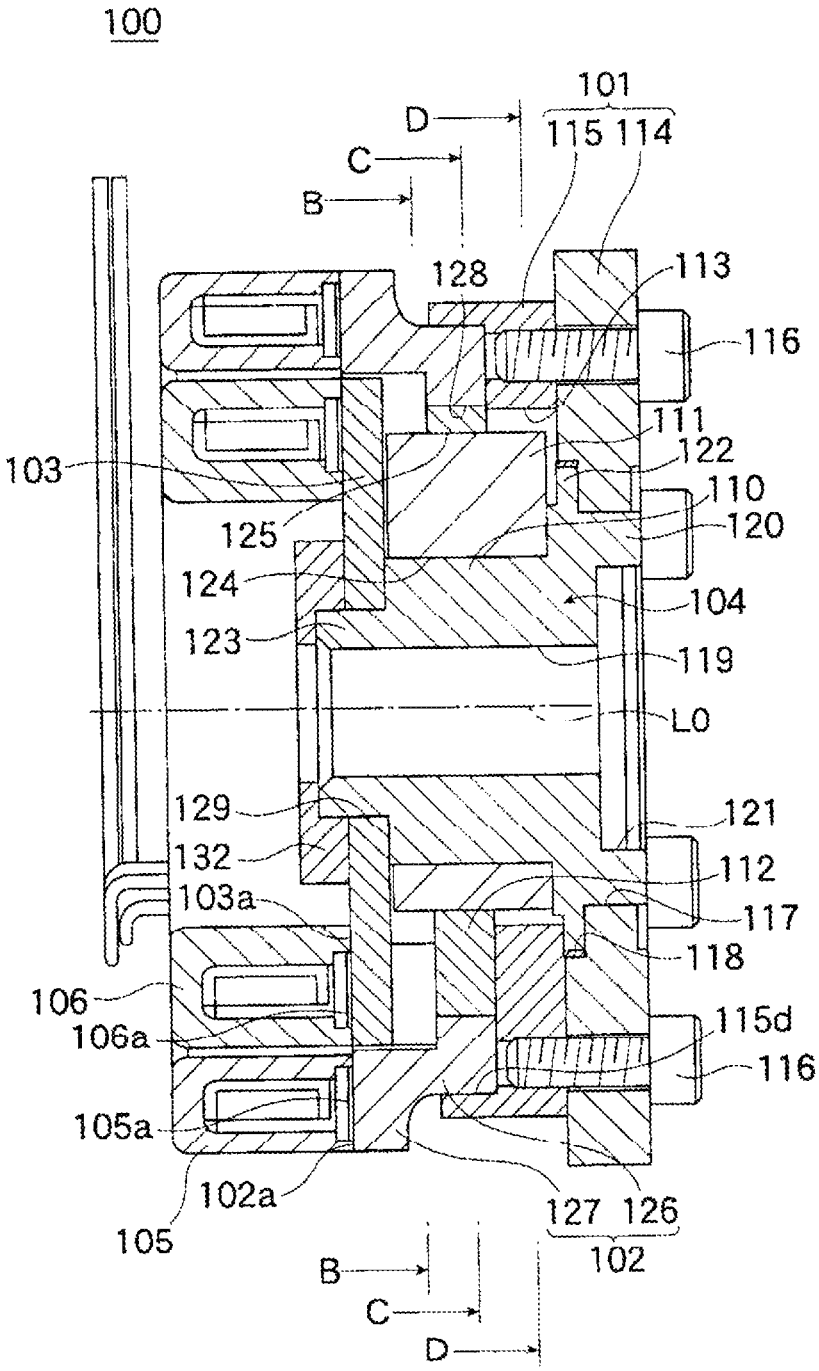
FIG. 4 is a cross sectional view taken along Line A-A or FIG. 3.

100 and 140 phase varying apparatus for automobile engine
101 and 141 drive rotor
102 and 142 first control rotor
103 and 143 second control rotor
105 and 145 first electromagnetic clutch (first torque means)
106, 146 second electromagnetic clutch)(second torque means)
107, 147 phase angle varying mechanism
110, 150 circular eccentric cam
111, 151 first link
112, 152 second link
113, 113' first link guide groove) (quasi-radial guide mechanism)
115 drive cylinder of drive rotor
115*d* cylindrical portion
130, 149 displacement forcing means
130*a* crescent-shaped guide wall
130*b* semi-circular guide wall
132 bush
132*a*, 132*b* cutaway portions on the opposite sides of hush
133 circular hole
153 slide member guide groove (quasi-radial guide mechanism)
155 slide member (quasi-radial guide mechanism)
166 quasi-radial guide mechanism
174 first through-hole (quasi-radial guide mechanism)
175 third link (displacement forcing means)
177 fifth circular eccentric hole) (displacement forcing means)
178 second through-hole (displacement forcing means)
D1 rotational direction of drive rotor (phase advancing direction)
D2 direction opposite to D1 (phase retarding direction)
D3 and D4 quasi-radial direction of drive rotor.
L10 (rotational) axis of camshaft
L1, L1' cam center of circular eccentric cam
L2, L2' central axis of first link
L3, L3' central axis of second link
L10 central axis of slide member

BEST MODE FOR CARRYING THE INVENTION

Referring to the accompanying drawings, the invention will now be described in detail by way of example. Any of the phase varying apparatuses shown in the following examples is mounted on an automobile engine to transmit the rotation of the crankshaft to the camshaft in synchronism with the crankshaft of the engine to open/close intake/exhaust valves, the phase varying apparatuses being designed to vary open/close timing of the valves in accordance with the engine load and rpm for example.

Referring to FIGS. 1 through 8, there is shown a phase varying apparatus in accordance with a first embodiment 100. The apparatus 100 has a drive rotor 101 driven by the crankshaft, first control rotor 102, second control rotor 103, center shaft 104 integrally coupled to the camshaft (not shown), first electromagnetic clutch (first torque means) 105, second electromagnetic clutch (second torque means) 106, and a phase angle varying mechanism 107.

The phase angle varying mechanism 107 is provided to vary the phase angle of the camshaft (center shaft 104) relative to the drive rotor 101 (crankshaft). The phase angle varying mechanism 107 consists of a four-link mechanism 108 and a displacement forcing means 130. The four-link mechanism 108 includes a circular eccentric cam 110 integral with the center shaft 104; first and second links 111 and 112, respectively, in the forms of substantial cylinders; and a first link guide groove 113 formed in the drive rotor 101. (This link guide groove is the quasi-radial guide mechanism defined in claims 1 through 4). The displacement forcing means 130 consists of a crescent-shaped guide wall 130*a* and a semi-circular guide wall semi-circular guide wall 130*b* formed in the second control rotor 103. In what follows one end of the apparatus 100 having second electromagnetic clutch 106 will be referred to as the front end, and the other end of the apparatus 100 having drive rotor 101 will be referred to as rear end. The rotational direction of the drive rotor 101 as viewed from the front end will be referred to as phase advancing direction D1 (which is the clockwise direction), and the opposite direction as phase retarding direction D2 (which is the counterclockwise direction).

The drive rotor 101 includes a sprocket 114 and a drive cylinder 115 which are integrally assembled by means of coupling pins 26 passed through a multiplicity of mounting holes (114*a* and 115*a*) formed in the 115. The sprocket 114 has a circular through-hole 117 and a stepped circular hole 118 The drive cylinder 115 is formed with a cylindrical section 115*b* and a bottom 115*c*. Formed at the center of the bottom 115*c* is a rectangular through-hole extending in a quasi-radial direction to serve as a first link guide groove 113.

The center shaft 104 has a circular eccentric cam 110, central through-hole 119, large cylindrical portion 120, stepped circular hole 121 formed in the rear end of the large cylindrical portion 120, flange portion 122, and small cylindrical portion 123. The circular eccentric cam 110, flange portion 122, and large cylindrical portion 120 are integrally coupled with the flange portion 122 sandwiched between the circular eccentric cam 110 and large cylindrical portion 120. The circular eccentric cam 110 has a cam center L1 offset from the rotational axis L0 of the center shaft. Provided ahead of the eccentric cam 110 is a small cylindrical portion 123 which is rotatable about the rotational axis L0.

The camshaft (not shown) is fitted in the stepped circular hole 121 formed in the rear end of the center shaft 104 and coaxially coupled integrally with the center shaft 104. By inserting the large cylindrical portion 120 and the flange portion of the center shaft 104 in the circular through-hole 417 and stepped circular hole 118 of the sprocket 114, the drive rotor 101 is supported by the center shaft 104 rotatably about the rotational axis L0. The circular eccentric cam 110 projects forward from the first link guide groove 113 and eccentrically rotates about the rotational axis L0 together with the camshaft (not shown).

The first link 111 has a substantially cylindrical shape and has a first central axis L2 and a first circular eccentric through-hole 124 offset from the first central axis L2. The first circular eccentric through-hole 124 has substantially the same inner diameter as the outer diameter of the circular eccentric cam 110, allowing the circular eccentric cam 110 to rotate in the first circular eccentric through-hole 124. The first link 111 is rotatably supported by the circular eccentric cam 110 by inserting the circular eccentric cam 110 in the first circular eccentric through-hole 124, thereby allowing the first link 111 itself to eccentrically rotate about the cam center L1.

The first link 111 has an outer diameter, which is substantially the same as the width of the first link guide groove 113. The first link 111 is inserted in the first link guide groove 113. The first link 111 abuts against the flat faces 113*a* and 113*b* formed on the opposite sides of the first link guide groove 113 so that the first link 111 can move along the direction of the quasi-radial guide first link guide groove 113.

Like the first link 111, the second link 112 also has a substantially cylindrical form and has a second circular eccentric through-hole 125 offset from the second central axis L3 of the second link. The second circular hole 125 has an inner diameter which is substantially the same as the outer diameter of the first link 111, allowing the inserted first link 111 to rotate in the second circular hole 125. The second link 112 is rotatably supported by the first link 111 by inserting the first link 111 in the second circular hole 125. The second link 112 is rotatable about the first central axis L2 of the first link 111.

The first control rotor 102 has a front section in the form of a small cylindrical portion small cylindrical portion 126 and a hind section in the form of a large cylindrical portion 127 integrated together. The small cylindrical portion 126 is rotatably inscribed in the inner circumferential wall 115*d* of the cylinder drive cylinder 115, which makes it possible to support the first control rotor 102 by the drive cylinder 115 As a consequence, the first control rotor 102 is coaxial with the drive rotor 101 and rotates about the rotational axis L0.

The 102 has a third circular eccentric through-hole 128 formed in the small cylindrical portion 126, offset from the rotational axis L0. The inner diameter of the third circular hole 128 is substantially the same as the outer diameter of the second link 112. The second link 112 inserted in the third circular hole 128 is thus rotatably inscribed therein. The second link 112 is supported by the first link 111 via the second circular hole 125 on one hand. On the other hand, its outer periphery is held by the third circular hole 128. The second link 112 eccentrically rotates about the first central axis L2 of the first link 111, and at the same time eccentrically rotates about the rotational axis L0 of the first control rotor 102.

In this configuration, the circular eccentric cam 110, first link 111, and second link 112 linked together by the third circular hole 128 (rotatably holding therein the inscribed second link 112) and the first link guide groove 113 (quasi-radial guide mechanism holding the first link 111 movable in a quasi-radial direction) establish a four-link mechanism having four nodes at the cam centers L1, L2, central axis L3 of the second link, and the rotational axis L0.

The first electromagnetic clutch 105 is securely fixed to the engine (not shown), ahead of the first control rotor 102. The first control rotor 102 has a front surface 102*a*, which can be attracted onto the friction member 105*a* when attracted by the first electromagnetic clutch 105, whence the first control rotor 102 is rotated relative to the 101 and changes the phase angle of the camshaft relative to the drive rotor 101 in a predetermined direction.

The center shaft 103 is arranged inside the large cylindrical portion of the first control rotor 102, while the second electromagnetic clutch 106, also securely fixed to the engine, is arranged ahead of the center shaft 103. The center shaft 103 has at the center thereof a circular through-hole 129 for rotatably inscribing therein the center shaft 104. Formed on the outer periphery of the center shaft 103 are a guide wall 130*a* in the form of a substantially crescent-shaped protrusion that extends rearward, and a semi-circular guide wall 130*b* protruding rearward from the opposite end of the second control rotor across the rotational axis L0. These guide walls 130*a* and 130*b* constitute a displacement forcing means 130, as recited in claims 1 through 4.

The small cylindrical portion 123 is inserted in the circular through-hole 129 to rotatably support the center shaft 104. The guide walls 130*a* and 130*b* support the opposite sides of the outer periphery of the first link 111 extending forward from the second circular hole 125 of the second link 112. The center shaft 103 is rotated relative to the drive rotor 101 when the front end 103*a* of the center shaft 103 is attracted onto the friction member 106*a* of the second electromagnetic clutch 106, thereby changing the phase angle of the camshaft relative to the drive rotor 101 in the opposite direction as compared with the rotation caused by the first electromagnetic clutch.

A holder (or bush) 132 is arranged on the leading end of the small cylindrical portion 123 of the center shaft 104 that protrudes forward from the circular through-hole 129. The holder 132 and center shaft 104 are fixed to the leading end of the camshaft (not shown) with a bolt (not shown) inserted into the central holes formed in these members.

Figure 6:
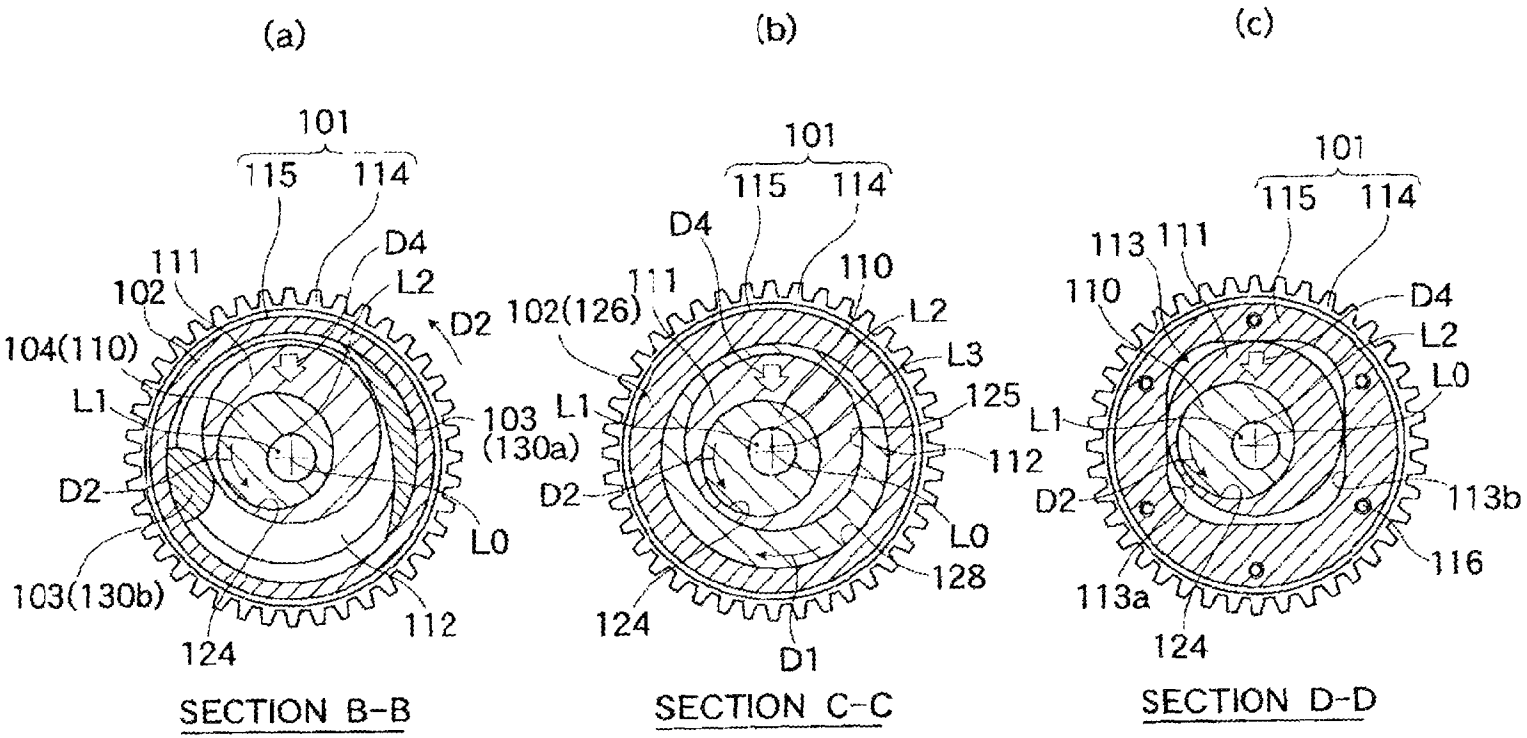
FIG. 6 shows radial cross sections of the apparatus of the first embodiment after a phase change has taken place. More particularly, FIG. 5(*a*) shows the cross section taken along Line D-D of FIG. 4.
Figure 7:
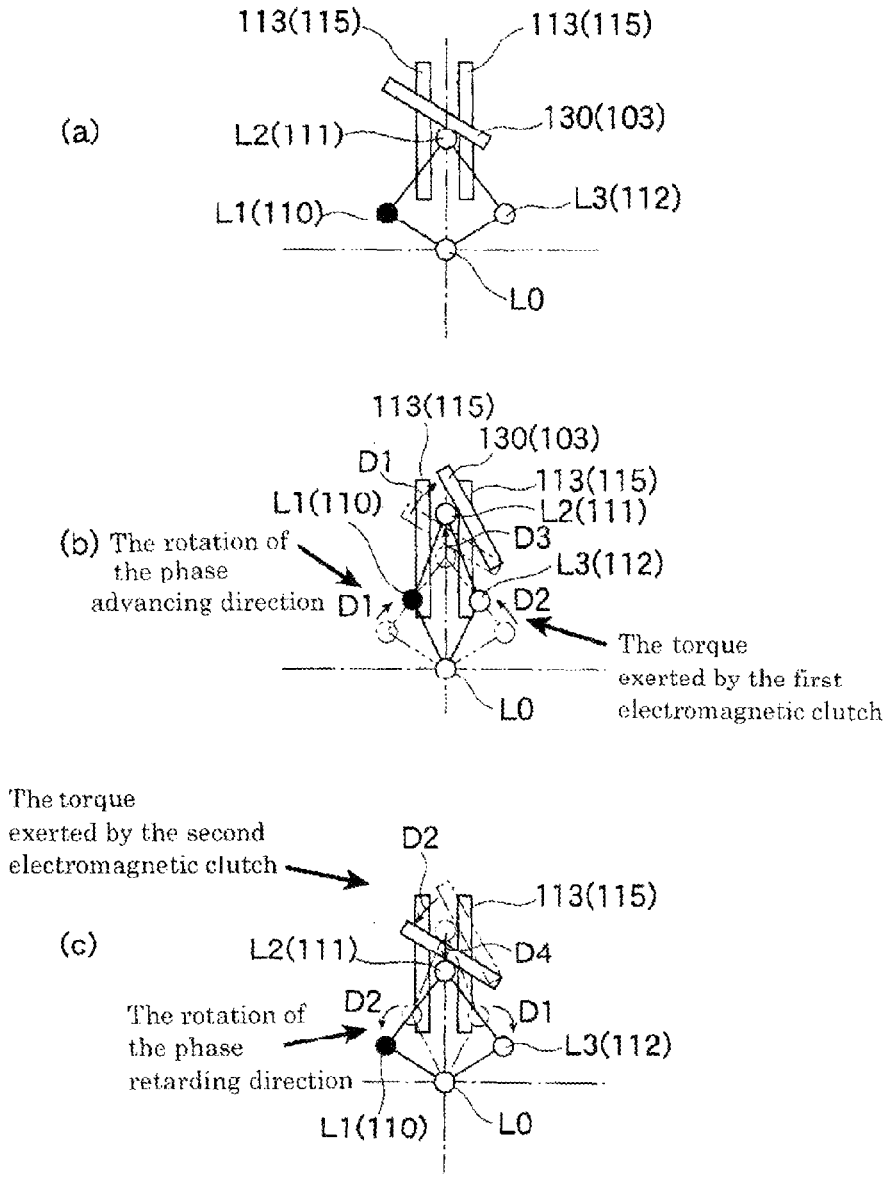
FIG. 7 shows in schematic diagram illustrating operations of the four-link mechanism used in the phase varying apparatus in accordance with a first embodiment of the invention. More particularly, FIG. 7(*a*) shows an arrangement before any phase change has taken place.

Next, referring to FIGS. 5 through 7, operation of the phase varying apparatus in accordance with the first embodiment will now be described. Under the initial condition where the first and second electromagnetic clutches are turned off, the camshaft (center shaft 104), first control rotor 102, center shaft 103, first link 111, and second link 112 are operably coupled to the sprocket 114 (drive rotor 101) driven by the crankshaft (not shown) and are rotated in the clockwise direction D1 as shown in FIG. 1.

When the 105 is enabled, the central axis L3 acting as a node of the four-link mechanism 108 rotates about the rotational axis L0 in the counterclockwise direction D2, thereby moving the node (first central axis L2) upward in the direction D3, that is, along the first link guide groove 113. As a consequence, the phase varying apparatus changes its configuration shown in FIG. 5(*a*)-(*c*) to a configuration shown in FIG. 6(*a*)-(*c*), for example.

Figure 5:
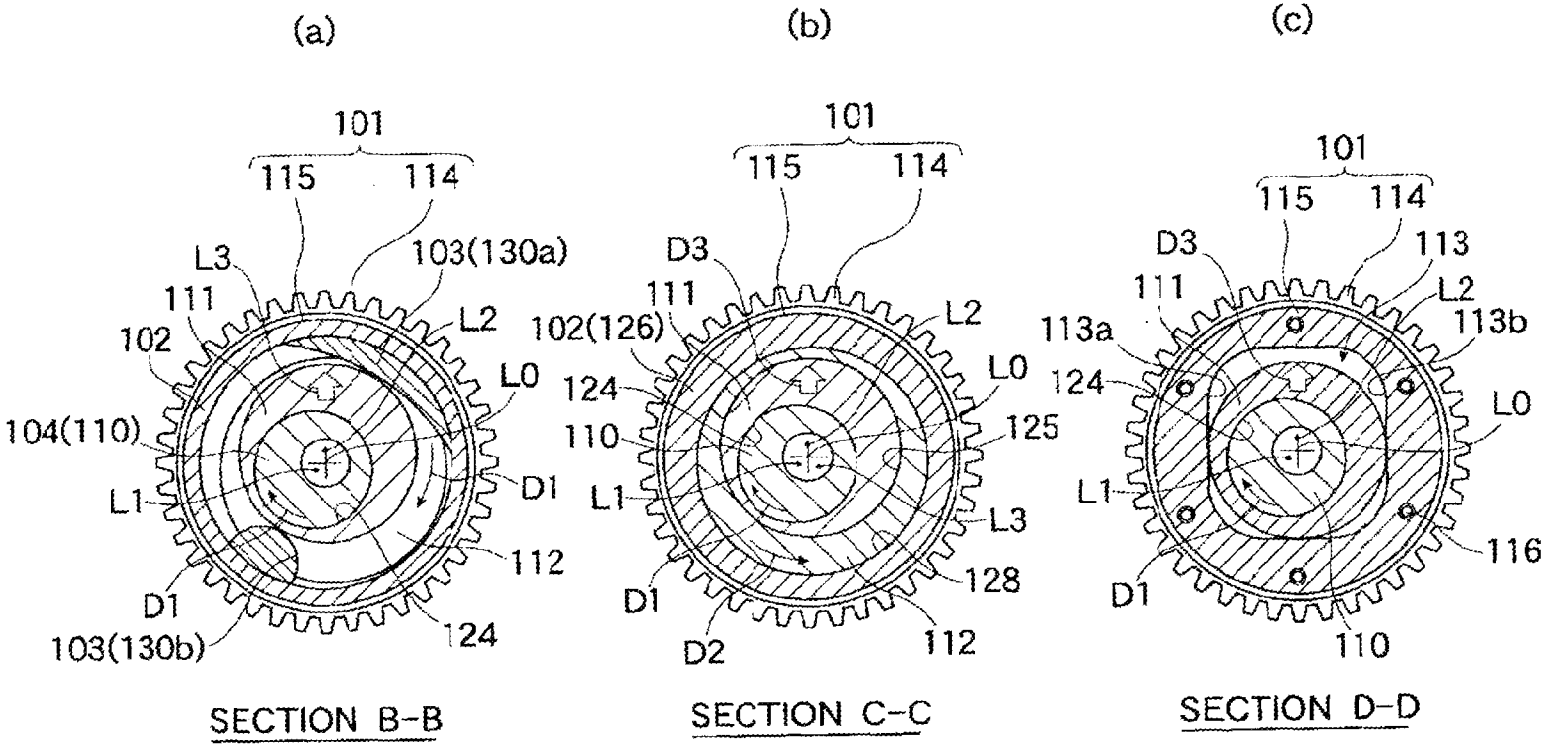
FIG. 5 shows radial cross sections of a phase varying apparatus (in phase retarding mode) before any phase change has taken place. More particularly, FIG. 5(*a*) shows the cross section taken along Line D-D of FIG. 4.

In other words, when the first control rotor 102 shown in FIG. 5(*b*) is subjected to a braking torque exerted by the first electromagnetic clutch 105, it is retarded in rotation relative to the drive rotor 101, so that it is relatively rotated in the phase retarding direction D2. During this rotation, the central axis L3 of the second link, acting as one node of the four-link system, is rotated in the counterclockwise direction D2 about the rotational axis L0, together with the third circular eccentric hole 128. Since the first link 111 is inscribed in the second circular hole 125 and the opposite sides of the first link 111 are supported by the first link guide groove 113, the first central axis L2 of the first link acting as another node of the four-link system is moved along the quasi-radial first link guide groove 113 in the upward direction D3, as shown in FIG. 5(*c*). The guide walls 130*a* and 130*b* integral with the center shaft 103 of FIG. 5(*a*), subjected to a torque (for causing rotation in the clockwise direction D1) exerted by the first link 111 that goes up in the direction D3, are rotated in the clockwise direction D1 relative to the 101.

As the first central axis L2 moves upward, the cam center L1 of the circular eccentric cam 110 acting as still another node of the four-link system is rotated in the clockwise direction D1 about the rotational axis L0 together with the first circular eccentric through-hole 124. The circular eccentric cam 110 of shown in FIG. 5(*b*) eccentrically rotates about the rotational axis L0 relative to the drive rotor 101 (the drive cylinder 115 that has the first link guide groove 113). As a consequence, the center shaft 104 (camshaft not shown) integral with the circular eccentric cam 110 is rotated in the phase advancing direction D1 relative to the drive rotor 101 (crankshaft not shown), thereby advancing the phase angle of the camshaft in the direction D1 relative to the drive rotor 101

On the other hand, when the second electromagnetic clutch 106 is enabled, the crescent-shaped guide wall 130*a* and the semi-circular guide wall 130*b*, both rotating in the D2 direction, push the node (first central axis L2) along the first link guide groove 113 in the D4 direction, thereby rotating the node (central axis L3) in the clockwise direction D1, but rotates the node (central axis L1) in the counterclockwise direction D2 relative to the central axis L3. As a consequence, configuration of the four-link system shown in FIG. 6 returns to the configuration shown in FIG. 5, while the configuration shown in FIG. 7(*b*) returns to the configuration shown in FIG. 7(*c*), thereby returning the center shaft 104 (camshaft) relative to the drive rotor 101 in the phase retarding direction D2.

In other words, when the second electromagnetic clutch 106 is enabled, the center shaft 103 is subjected to a braking torque, which causes the drive rotor 101 to be retarded in rotation relative to the drive rotor 101, and rotated in the phase retarding direction D2 about the rotational axis L0 together with the guide walls 130*a* and 130*b*. In this instance, the guide walls 130*a* and 130*b* exert a downward force to the first link 111 (in the D4 direction), thereby lowering the first link 111 held in the first link guide groove 113 in the downward direction D4 along the first link guide groove 113.

As the first link 111 and first central axis L2 moves downward, the central axis L3 of the second link 112 rotates in the clockwise direction D1, and the cam center L1 of the circular eccentric cam 110 rotates in the counterclockwise direction D2. As a consequence, the center shaft 101 (camshaft not shown) integral with the circular eccentric cam 110 rotates in the phase retarding direction D2 relative to the drive rotor 101. (crankshaft not shown), thereby returning the camshaft in the phase retarding direction D1 relative to the drive rotor.

Figure 8:
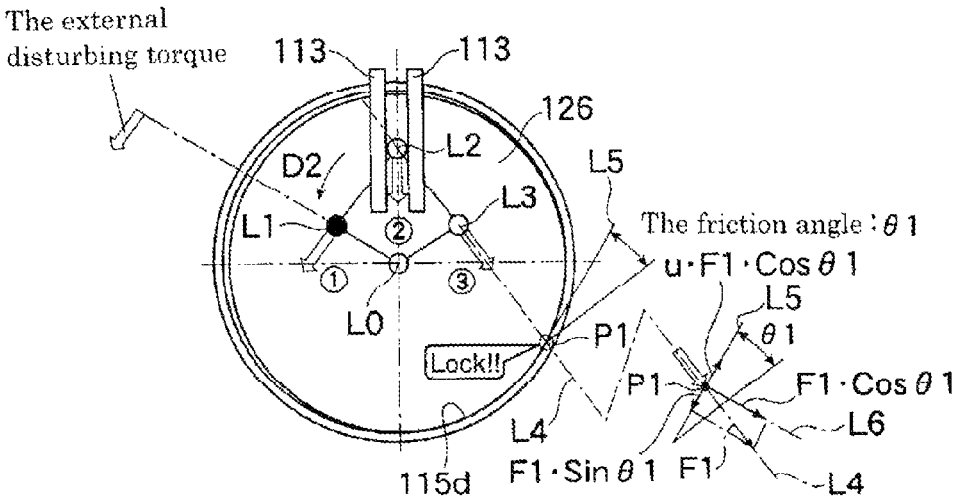
FIG. 8 shows operations of the self-locking mechanism used in the first embodiment. More particularly, FIG. 8(*a*) shows an external disturbing torque acting on the self-locking mechanism in the phase retarding direction.
Figure 8:
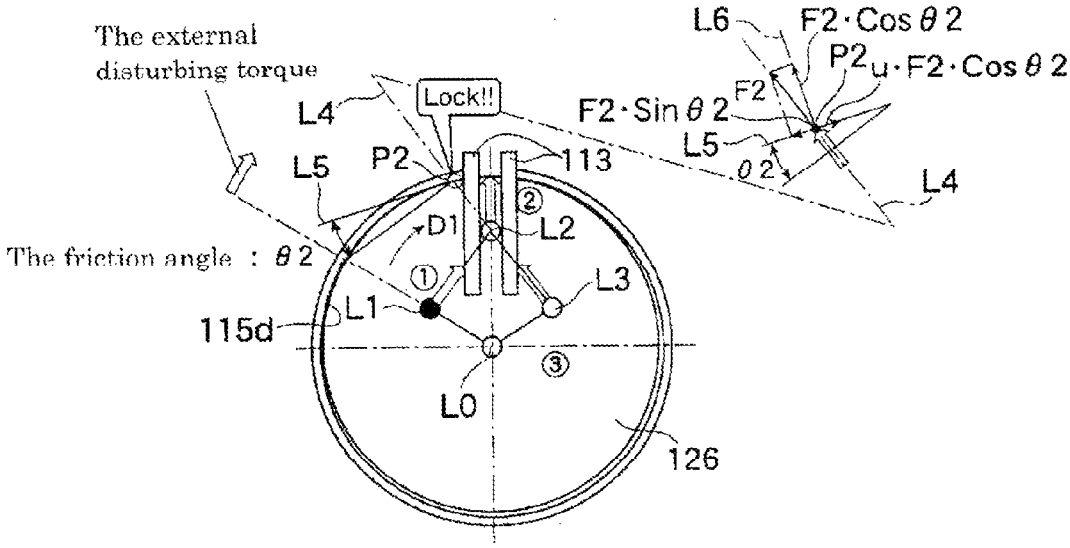

Next, referring to FIG. 8(*a*)-(*b*), there is shown a self-locking mechanism for preventing an external disturbing torque from generating a gap in phase angle between center shaft 104 (camshaft) and the drive rotor 101 (crankshaft) if the camshaft is subjected to an external disturbing torque, where an external disturbing torque is a torque that arises from a reaction of a valve spring and forces the camshaft (center shaft 104) in rotation to rotate relative to the drive rotor 101 when transmitted to the camshaft. FIG. 8(*a*) shows an external disturbing torque causing camshaft rotation in the counterclockwise direction D2, and FIG. 8(*b*) shows an external disturbing torque causing camshaft rotation in the clockwise direction D1.

When the circular eccentric cam 110 integral with the camshaft is subjected to an external disturbing torque causing rotation in the direction D2 or D1, the second link 112 is acted upon by a force F1 or F2 exerted by the first link 111 (which is guided by the first link guide groove 113 in a quasi-radial direction) in the direction of the line L4 connecting the first central axis L2 of the first link and the central axis L3 of the second link. An external disturbing torque causing rotation in the direction D2 results in a force F1 in the direction from the first central axis L2 to the central axis L3 as shown in FIG. 8(*a*), while an external disturbing torque causing rotation in the direction D1 results in a force F2 in the direction from the first central axis L3 to the central axis L2 as shown in FIG. 8(*b*). The forces F1 and F2 transmitted to the respective intersections P1 and P2 of the line L4 and the circumference of the small cylindrical portion 126 (first control rotor 102) acts from the outer periphery of the small cylindrical portion 126 (first control rotor 102) to the inner circumferential wall 115*d* of the drive cylinder 115. As a consequence, there arises between the outer periphery of the small cylindrical portion 126 and the inner circumferential wall 115*d* of the drive cylinder a local frictional force that prevents the rotation of the small cylindrical portion 126 relative to the drive cylinder 115.

This frictional force can be calculated as follows. Let line L5 be the tangent to the small cylindrical portion 126 passing through the intersection P1 (or P2), line L6 be the normal perpendicular to line L5 at the intersection P1 (or P2), θ1 and θ2 be the angles of inclination of the respective lines L4 and L6, and μ be the friction coefficient between the small cylindrical section 126 and the inner circumferential wall 115*d* in contact with each other. A gap in phase angle between the drive rotor 101 and camshaft is caused by the component of the force in the tangential direction at the respective intersection P1 and P2, which is given by F1*sin q1 and F2*sin q2. The local frictional forces that prevent slidable motions of the outer periphery of the small cylindrical portion 126 from slipping on the inner circumferential wall 115*d* are given by m*F1*cos q1 and m*F2*cos q2.

If the frictional force exceeds the force that can cause slipping (and hence a phase gap), the first control rotor 102 and center shaft 104 will be locked together, since in this case no rotation of first control rotor 102 relative to the center shaft 104 takes place. As a consequence, by setting θ1 and θ2 to satisfy the following conditions $$F1*\sin\theta1<\mu*F1\cos\theta1 \text{ and } F2*\sin\theta2<\mu*F2\cos\theta2,$$

that is, $$\theta1<\tan^{-1}\mu \text{ and } \theta2<\tan^{-1}\mu$$

the self-locking effect will prevent any phase gap between the drive rotor 141 and center shaft 144 if the camshaft is subjected to an external disturbing torque.

Figure 9:
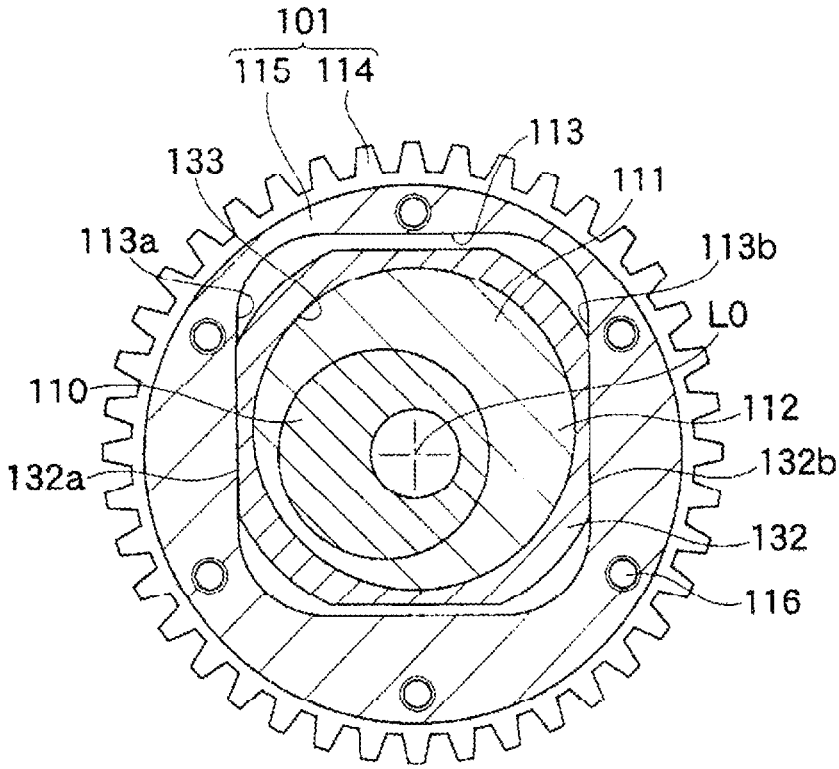
FIG. 9 shows a radial cross section of a phase varying apparatus in accordance with a second embodiment of the invention having a bush between the second link and a substantially-radial guide groove.

Referring to FIG. 9, there is shown a phase varying apparatus in accordance with a second embodiment of the invention defined in claim 3. This phase varying apparatus differs from the first phase varying apparatus in that the a hush 132 is provided between the first link 111 and first link guide groove 113, in contrast to the first embodiment in which the first link guide groove 113 is in contact with the opposite sides of the first link 111.

The bush 132 has a circular hole 133 for rotatably inscribing therein the first link 111 and parallel cutaway portions 132*a* and 132*b*, respectively, formed on the opposite sides of the bush 132. The distance between the cutaway portions 132*a* and 132*b* is substantially the same as the distance between the flat support surfaces 113*a* and 113*b* of the first link guide groove 113. The bush 132 is disposed in the first link guide groove 113 with the first link 111 inscribed in the circular hole 133

When one of the first electromagnetic clutch 105 and 106 is turned on, the bush 132 is acted upon by a force exerted by the first link 111 inscribed in the circular hole 133, and displaced in the first link guide groove 113 together with the first link 111. During this displacement of the bush 132, the first link 111 is not in contact with the first link guide groove 113, and the cutaway portions 132*a* and 132*b* in face contact with the flat supportive surfaces 113*a* and 113*b* slide on the surfaces 113*a* and 113*b*. As a consequence, the phase varying apparatus of the second embodiment is subjected to a less contact stress than the first embodiment in which the first link 111 is directly in contact with the first link guide groove 113 (circular object in line contact with a surface).

Figure 10:
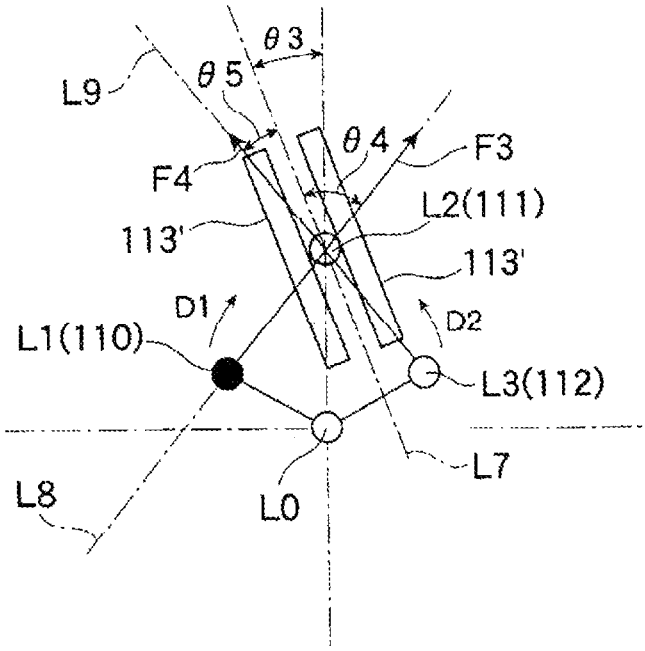
FIG. 10 shows a four-link mechanism of a phase varying apparatus in accordance with a third embodiment of the invention having an inclined quasi-radial guide groove

Referring to FIG. 10, a phase varying apparatus in accordance with a third embodiment of the invention will now be described. In the third embodiment, the first link guide groove 113 of the first and second embodiments are replaced by a first link guide groove 113' which is inclined through an angle θ3 in the counterclockwise direction D2 with respect to the line passing through the Axes L0 and L2.

Denoting by L7 the direction of the groove of the first link guide groove 113', by L8 the line passing through the axis L1 of the circular eccentric cam 110 and axis L2 of the first link 111, and by L9 the line passing through the central axes L3 and L2 of the second link 112 and first link 111, respectively, the first link guide groove 113' is acted upon by a force in the direction from the first link 111 along the line L8 when the circular eccentric cam 110 is acted upon by a torque about the rotational axis L0 for rotation in D1 direction shown in FIG. 10. On the other hand, the first link guide groove 113' is acted upon by a force F4 exerted by the first link 111 in the direction of line L8 when the first electromagnetic clutch 105 puts a brake on the first control rotor 102, so that the second link 112 is subjected to a torque about the rotational axis L0.

The forces F3 and F4 may be split into the components acting in the direction along the first link guide groove 113' (the component will be referred to as tangential component, which forces the first link 111 to be displaced in the groove) and the components acting in the direction perpendicular to the groove 113' (the component will be referred to as vertical component, which generates friction between the first link 111 and first link guide groove 113'). The more the angle between the tangent to the guide groove 113' and the direction of the acting force decreases, the more the tangential component increases, but the frictional force decreases, whence displacement of the first link 111 can take place more easily in the guide groove 113'.

In a third embodiment, in order to make the angle θ4 between the lines L7 and L8 larger while making the angle θ5 between the lines L7 and L9 smaller, the guide groove 113' is inclined through an angle of θ3 with respect to a radial direction in the counterclockwise direction D2. As a consequence then, when the first electromagnetic clutch 105 is enabled to give the second link 112 a torque, the first link 111 can move in the first link guide groove 113 more easily due to the fact that the friction between the first link 111 and first link guide groove 113 is small, thereby facilitating a change in phase angle between the center shaft 104 and drive rotor 101. On the other hand, in the event that an external disturbing torque is inputted to the circular eccentric cam 110, the friction between the first link 111 and 113' is large enough to prevent the displacement of the first link 111 in the guide groove 113', thereby preventing a change in the phase angle to occur. It is noted that the guide groove 113' may be designed to have a curvature that can maintain a constant angle between the guide groove 113' and the acting force F3 or F4.

Next, referring to FIGS. 11-16, a phase varying apparatus in accordance with the fourth embodiment of the invention and recited in claim 5 will now be described. A phase varying apparatus 140 of the fourth embodiment has a drive rotor drive rotor 141 driven by the crankshaft of the engine; a first control rotor 142; a second control rotor 143; a center shaft 144 integrally connected to the camshaft (not shown); a first electromagnetic clutch 145 (first torque means); a second electromagnetic clutch 146 (second torque means); and a phase angle varying mechanism 147.

The phase angle varying mechanism 147 consists of a four-link system 148 and a relative-phase varying means described in detail later. The four-link system 148 consists of a circular eccentric cam 150 integral with the center shaft 144, a substantially cylindrical first link 151, a substantially cylindrical second link 152, and a quasi-radial guide mechanism 166.

The drive rotor 141 consists of a sprocket 156 and a drive disc 157 integrated with the sprocket 156 by means of coupling pins 158 passing through mounting holes 156*a* and 156*b*. The sprocket 156 has at the center thereof a circular through-hole 159 and a stepped circular hole 160. The drive disc 157 is provided with a central circular through-hole 161 and a slide member guide groove 153 which is contiguous to the inner circumference of the circular through-hole 161. The slide member guide groove 153 is a linear quasi-radial groove inclined with respect to a radial direction of the rotary disc 141, and is adapted to guide the slide member 155 in the groove. The slide member is formed by fitting a hollow cylindrical shaft 155*b* onto one end of the thin circular shaft 155*a*. The transverse width of the slide member guide groove 153 is substantially the same as the outer diameter of the thick hollow circular shaft 155*b* of the slide member. The slide member guide groove 153 guides the thick hollow circular shaft 155*b* (fitted in the slide member guide groove 153) along the slide member guide groove 153.

The first control rotor 142 is shaped in the form of a cylinder having a bottom 162. The bottom 162 has a third circular eccentric hole 163, central circular hole 164, and an insertion groove 154 in the form of a through-hole for passing therethrough the slide member 155. The third circular eccentric hole 163 has substantially the same inner diameter as the outer diameter of the second link 152, and is adapted to rotatable receive therein the second link 152.

The insertion groove 154 is an escape groove for preventing the slide member that moves within the slide member guide groove 153 from touching the bottom 162. Thus, the insertion groove 154 has a width wider than the outer diameter of the thin circular shaft 155*a*. The insertion groove 154 extending in the rotational direction D1 of the drive rotor has a continuously decreasing radius. It is noted that the opposite ends 154*a* and 154*b* of the insertion groove 154 function as stoppers for limiting the displacement of the thin circular shaft 155 in the insertion groove 154 so as to define the displacement of the slide member.

The center shaft 144 has a circular eccentric cam 150, central circular through-hole 167, large cylindrical portion 168, stepped circular hole 169 behind the large cylindrical portion 168, flange portion 170, middle cylindrical portion 171, and small cylindrical portion 165. The large cylindrical portion 168, flange portion 170, middle cylinder portion 171, and small cylindrical portion 165 are coaxially integrated together to rotated about the rotational axis L0. The circular eccentric cam 150 is sandwiched between the middle cylinder portion 171 and small cylindrical portion 126 and integrated together, with its eccentric cam center L1' offset from the rotational axis L0 so as to rotate eccentrically about the rotational axis L0.

The camshaft (not shown) is integrally coupled to the center shaft 144 across the stepped circular hole 169, so that the camshaft and the center shaft 144 can rotate together about the rotational axis L0. The large cylindrical portion 168 of the center shaft 144 is slidably and rotatably inscribed in the circular through-hole 159 of the sprocket 156, and the middle cylindrical portion 171 is passed through the stepped circular hole 160 of the drive disc 157, so that the drive rotor 141 is supported by the center shaft 144 rotatably about the rotational axis L0. The middle cylinder portion 171 is rotatably and slidably inscribed in the circular through-hole 164, so that the first control rotor 142 is supported by the center shaft 144 rotatably about the rotational axis L0.

The first link 151 has a substantially cylindrical form and has a first circular eccentric through-hole 172 offset from the first central axis L2' of the first link. The inner diameter of the first circular eccentric through-hole 172 is substantially the same as the outer diameter of a circular eccentric cam 150 rotatably inscribed in the first circular eccentric through-hole 172. The first link 151 is supported by the circular eccentric cam 150 inscribed in the first circular eccentric hole 172 so as to eccentrically rotate about the cam center L1' of the first electromagnetic clutch 105.

The substantially cylindrical second link 152 is provided thereon with a second circular eccentric hole 173 and a small first insertion hole 174. The second circular eccentric hole 173 is formed at a position offset from the second central axis L3' of the second link, and has an inner diameter substantially the same as the outer diameter of the first link 151 so that the first link 151 is rotatably inscribed therein. The second link 152 is supported by the first link 151 inscribed in the second circular eccentric hole 173, and eccentrically rotates about the first central axis L2'. Further, while sliding in the third circular eccentric hole 163 of the first control rotor 142, the second link 152 eccentrically rotates about the rotational axis L0 together with the third circular eccentric hole 163.

A third link 175 is provided in the form of a substantial cylinder. This third link 175 has a fourth circular through-hole 176 formed at a position offset from the third central axis L4' of the third link, and a second small insertion hole 178. The fourth circular through-hole 176 allows the protruding circular eccentric cam 150 to pass through it without touching it.

The first and second insertion holes 174 and 178, respectively, of the second and third links 152 and 175, respectively, are through-holes having an inner diameter substantially the same as the outer diameter of the thin circular shaft 155*a*. The circular thin shaft 155*a* of the slide member 155 is rotatably inscribed in the first and second insertion holes 174 and 178, respectively.

The second control rotor 143 has a fifth circular and stepped eccentric hole 177 offset from the rotational axis L0 for rotatably inscribing the third link 175, along with the central circular through-hole 179. By inserting the small cylindrical portion 165 of the center shaft 144 in the circular through-hole 179 of the second control rotor 142, the second control rotor 142 is supported by the center shaft 144 rotatably about the rotational axis L0. The third link 175, slidable in the fifth circular eccentric hole 177, eccentrically rotates about the rotational axis L0 together with the fifth circular eccentric hole 177. The displacement forcing means 149 is constituted of the third link 175, and the fifth circular eccentric hole 177, and the second insertion hole second through-hole 178 for receiving therein the thin circular shaft 155*a* of the slide member. The displacement forcing means 149 provides the second link 152 with a force in a substantially radial direction.

One end of the thin circular shaft 155*a* of the slide member is inserted and passed through the insertion groove 154 of the First control rotor 142, first insertion hole 174 of the second link 152, and second through-hole 178 of the first insertion hole 174 in the order mentioned, while the thick hollow circular shaft 155*b* located at the other end is inserted in the insertion groove 154. The thin circular shaft 155*a* couples the second and third links 152 and 175, respectively, rotatably about the first and second insertion holes 174 and 178, respectively, and is slidably supported by the insertion groove 154. At the same time, the thick hollow circular shaft 155*b* is held in the slide member guide groove 153 slidably in a quasi-radial direction.

The quasi-radial guide mechanism 166 defined in claim 5 consists of the first insertion hole 174, the slide member guide groove 153, and the slide member 155 inserted into these holes. Incidentally, the first link 151, second link 152, and slide member 155 are assembled on the center shaft 144 such that the central axes L2', L3', and L10 of the first link 151, second link 152, and slide member 155, respectively, are coaxially aligned. The quasi-radial guide mechanism 166 can displace the second link 152 along the slide member guide groove 153 in collaboration with the displacement forcing means 149.

In collaboration with a third circular eccentric hole 163 for slidably receiving the inscribed second link second link 152, the circular eccentric cam 150, first link 151, second link 152, and quasi-radial guide mechanism 166 form the four-link mechanism 148 having four nodes that include the cam center and center axes L2', L3', and the rotational axis L0.

Arranged ahead of the first and second control rotors 112 and 143, respectively, are the first and second electromagnetic clutches 145 and 146, respectively. By attracting the front ends 142*a* and 143*a* of the first and second control rotors, respectively, to the frictional members 145*a* and 146*a* of the electromagnetic clutches 145 and 146, respectively, the first and second control rotors 142 and 143, respectively, are rotated relative to the drive rotor 141 so as to vary the phase angle of the camshaft in a predetermined direction.

Mounted at the leading end of the small cylindrical portion 165 of the center shaft 144 protruding from a circular through-hole 179 is a holder 180 having a circular hole 180*a* for receiving a bolt. The holder 180 and center shaft 144 are securely fixed to the leading end of the camshaft by means of the bolt (not shown) passed through the central holed formed in these members and screwed into the leading end of the camshaft.

Figure 11:
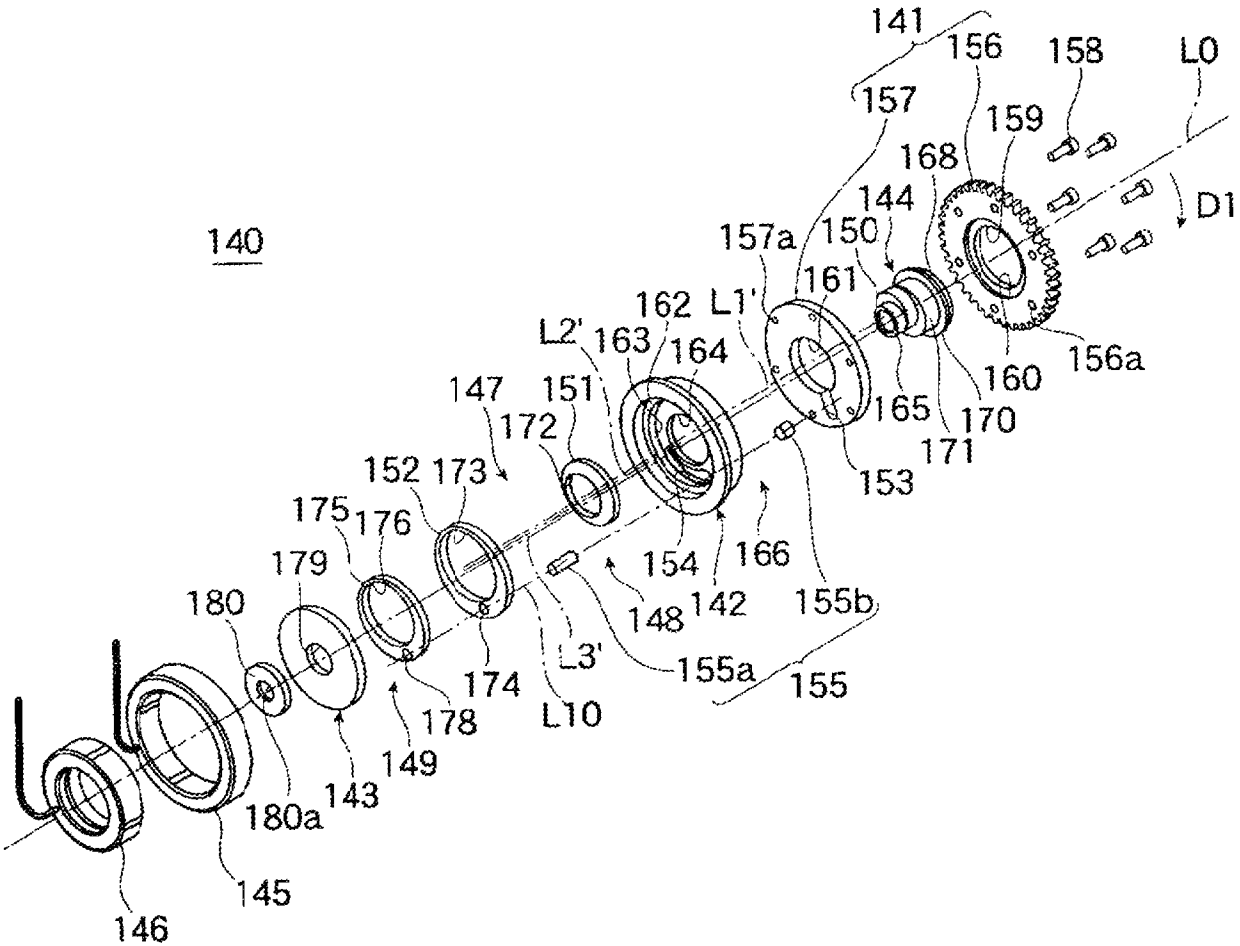
FIG. 11 is an exploded perspective view of a phase varying apparatus for an automobile engine as viewed from the front end of the apparatus in accordance with a fourth embodiment of the invention.
Figure 12:
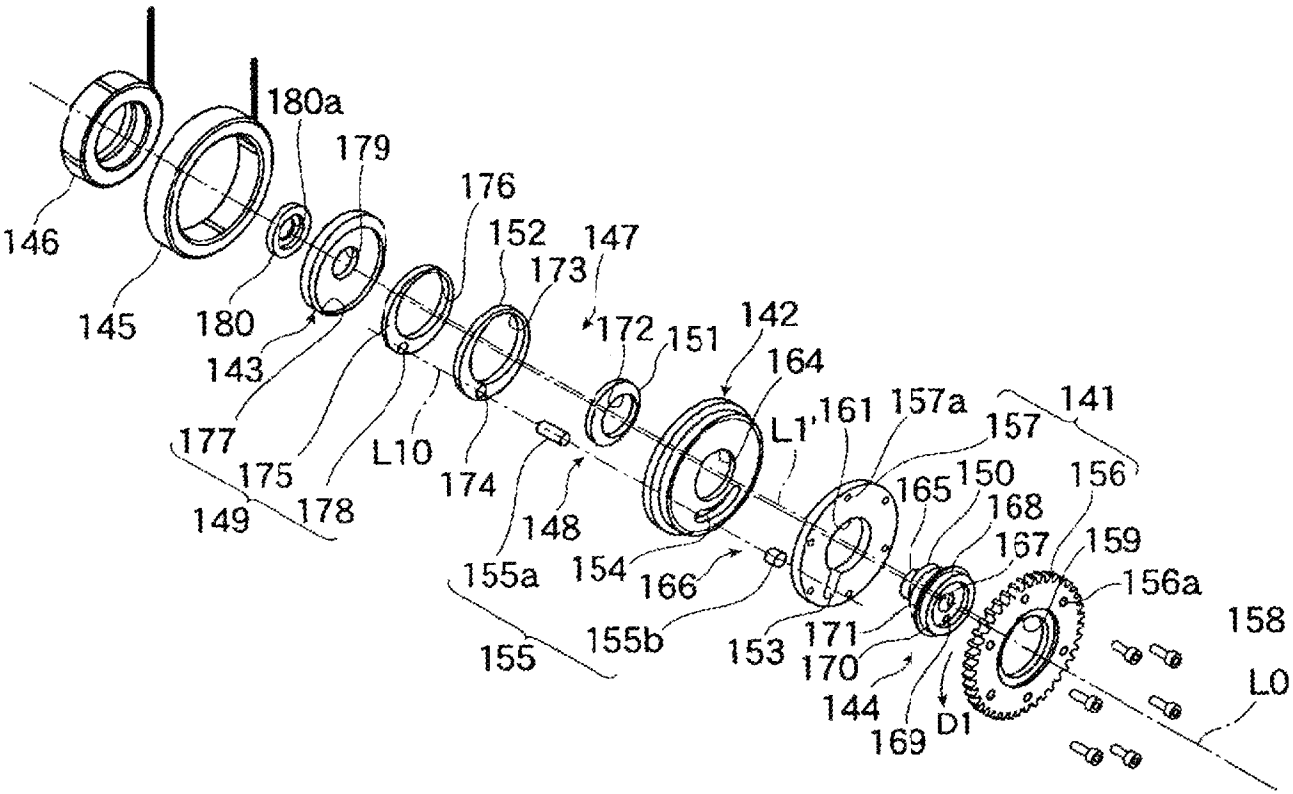
FIG. 12 is an exploded perspective view of the phase varying apparatus of FIG. 11 as viewed from the position of the drive rotor.
Figure 13:
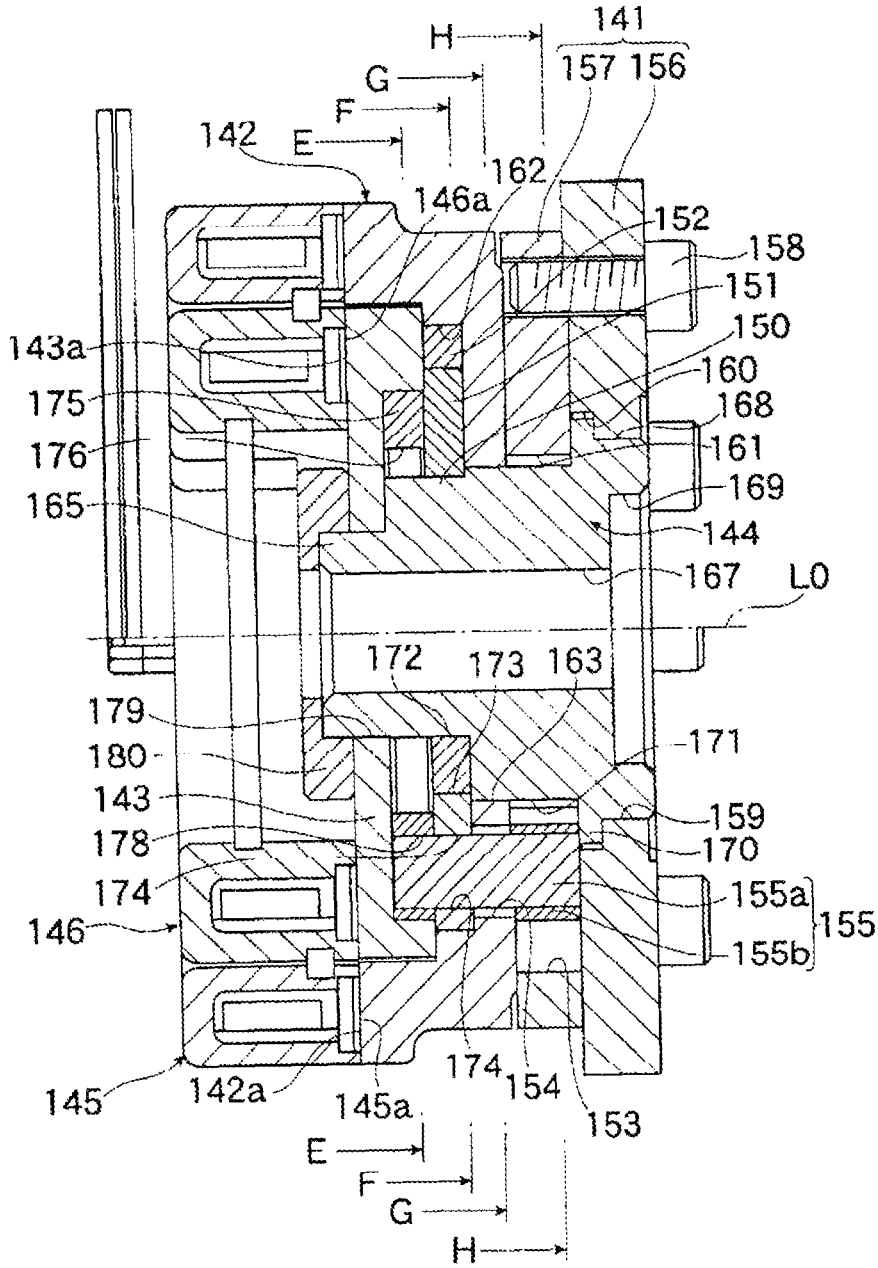
FIG. 13 is a axial cross section of a phase varying apparatus in accordance with a fourth embodiment of the invention.

Next, referring to FIGS. 14-16, operation of the phase varying apparatus of the fourth embodiment will now be described. Under the initial condition where the first and second electromagnetic clutches are turned off, the camshaft (center shaft 144), first control rotor 142, second control rotor 102, first link 151, second link 152, and third link 175 rotate in the clockwise direction D1 as shown in FIG. 11 together with the sprocket 156 (drive rotor 141) driven by the crankshaft.

Figure 16:
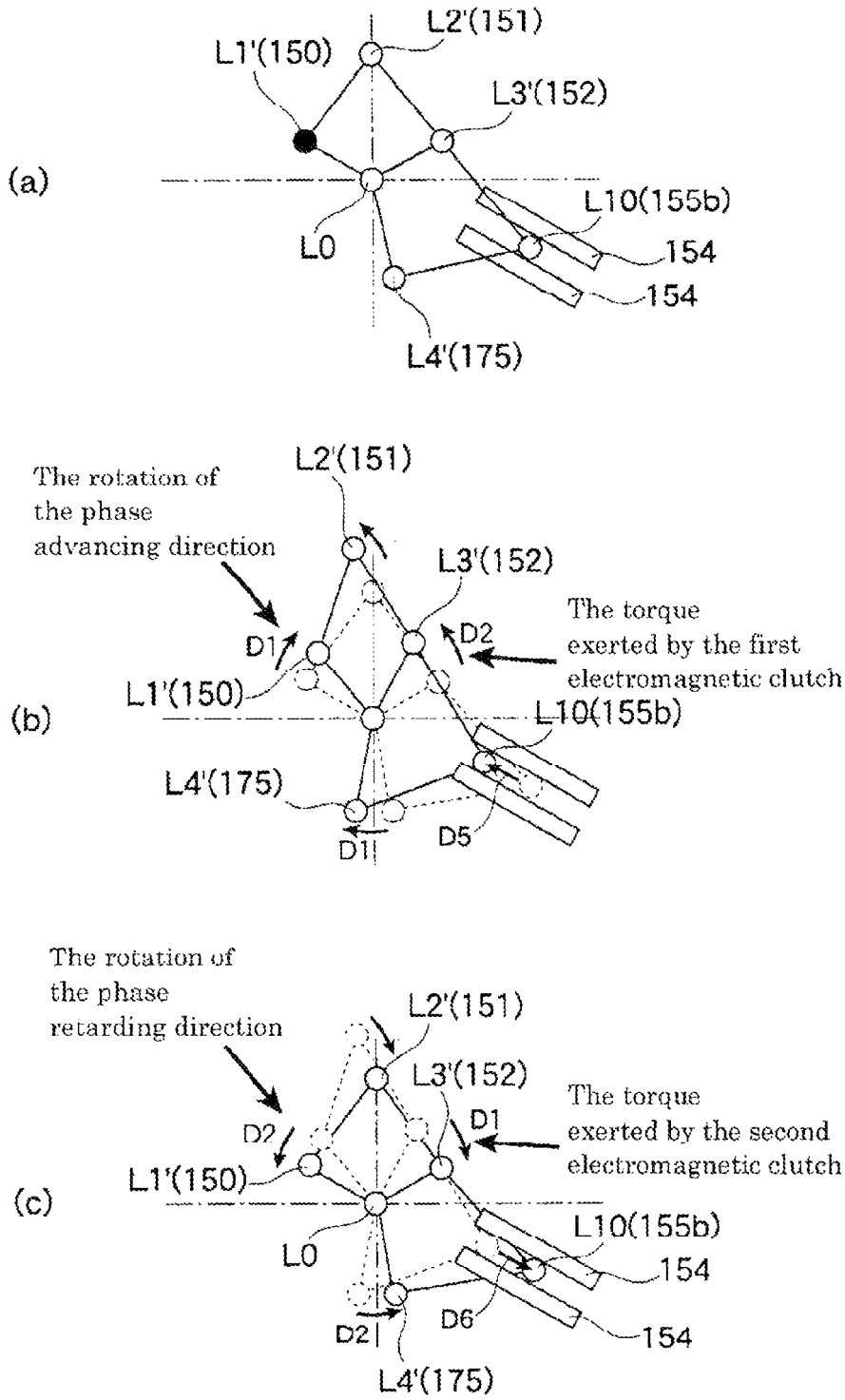
FIG. 16 illustrates operations of the four-link mechanism of the fourth embodiment. More particularly, FIG. 16(*a*) shows an arrangement of the four-link system before the first electromagnetic clutch is enabled.

Upon enablement of the first electromagnetic clutch 145, the central axis L3' of the second link acting as a node of the four-link system 148 is rotated about the rotational axis L0 in the counterclockwise direction D2, as shown in FIG. 16. The central axis L2' acting as another node, central axis L10 of the slide member, and the central axis L3' are aligned in the same straight line, and displaced together while keeping their linear alignment, thereby rotating the axis L1' (acting as a further node) in the clockwise direction D1. As a consequence, the phase angle of the center shaft 144 (camshaft) relative to the drive rotor 141 is varied in the phase advancing direction D1. On the other hand, if the second electromagnetic clutch 146 is enabled, the cam center L1' of the circular eccentric cam acting as a node of the four-link system 148 is rotated in the counterclockwise direction D2 as shown in FIG. 16(*c*), that is, in the opposite direction caused by the first electromagnetic clutch 145, thereby returning the drive rotor 141 in the phase retarding direction D2 relative to the center shaft 144.

Figure 15:
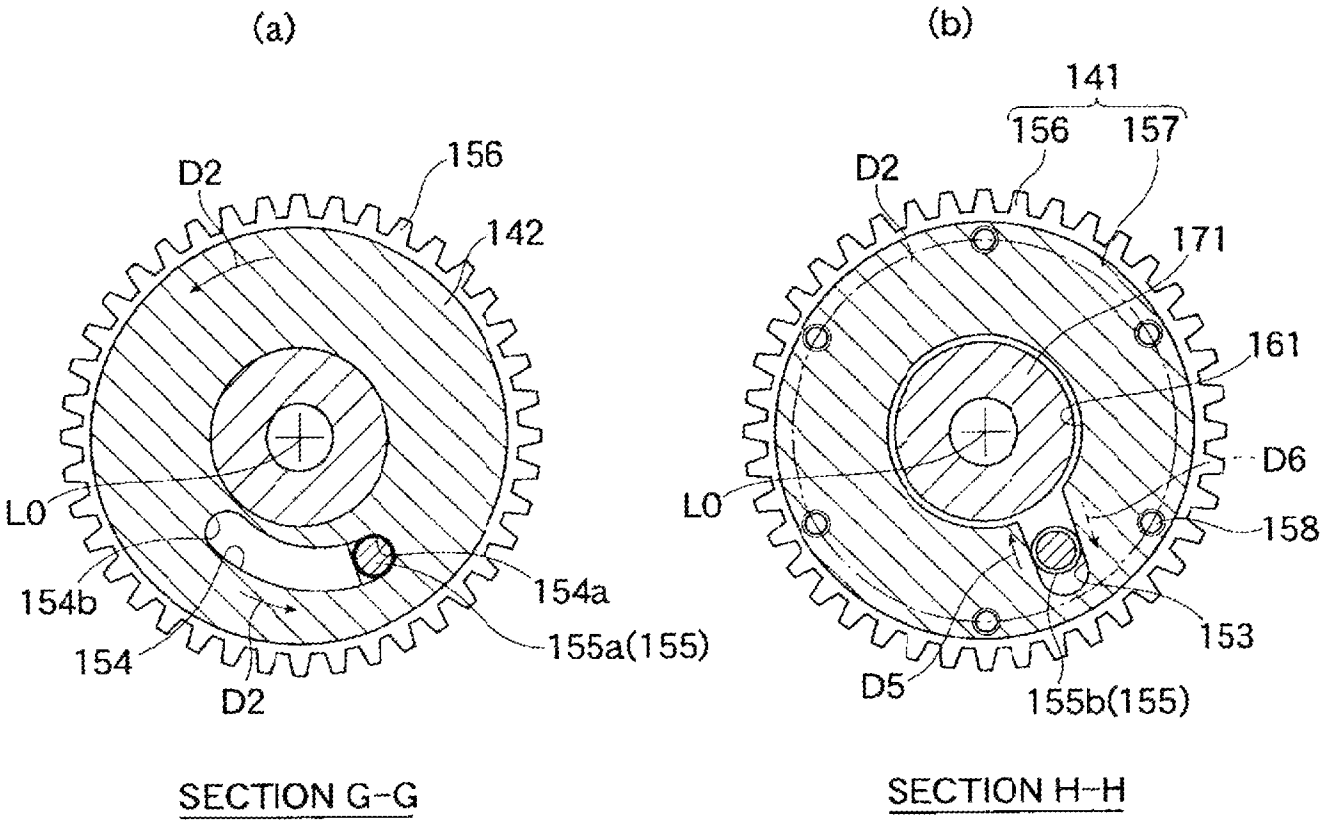
FIG. 15 shows radial cross sections of the apparatus of the fourth-embodiment. More particularly, FIG. 15(*a*) is a cross section taken along Line H-H of FIG. 13, and FIG. 15(*b*) a cross section taken along Line G-G of FIG. 13.

More specifically, under the braking torque exerted by the first electromagnetic clutch 145, the first control rotor 142 is retarded in rotation relative to the drive rotor 141 as shown in FIG. 15(*a*), and rotated in the phase retarding direction D2 relative to the drive rotor 141 together with the insertion groove 154. As the insertion groove 154 having a radius continuously decreasing in the phase retarding direction D2 is rotated in the direction D2, the thick hollow circular shaft 155*b* is guided by the slide member guide groove 153 as shown in FIG. 15(*b*), so that the slide member 155 is displaced in the slide member guide groove 153 in the radially inward direction D5.

Figure 14:
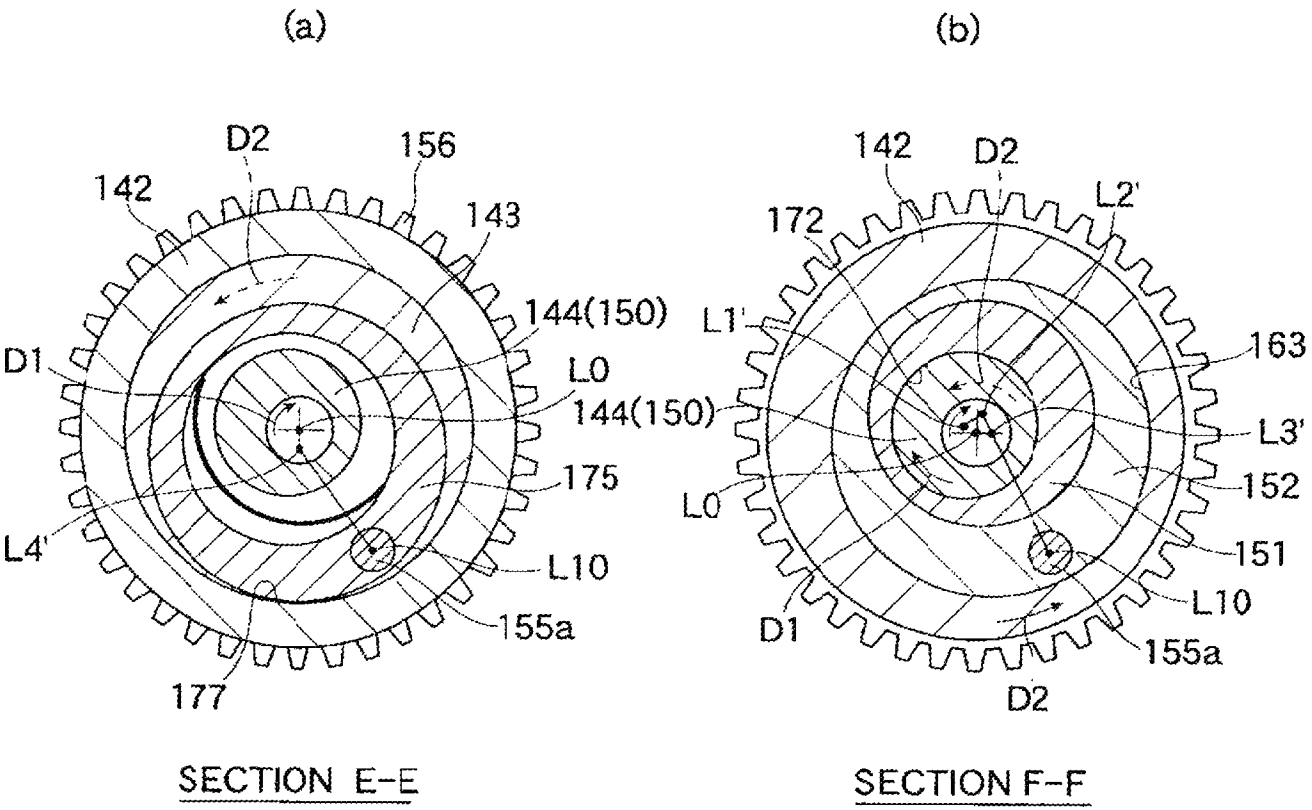
FIG. 14 shows radial cross sections of the apparatus of the fourth embodiment. More particularly, FIG. 14(*a*) is a cross section taken along Line F-F of FIG. 13, and FIG. 14(*b*) taken along Line E-E of FIG. 13.

At the same time, the central axis L3' of the second link 152 is rotated in the phase retarding direction D2 together with the third circular eccentric hole 163 as shown in FIG. 14(*b*). Since the second link 152 is coupled to the slide member that moves in the D5 direction in the slide member guide groove 153, the first link 151 is subjected to a force exerted by the wall of the second circular eccentric hole 173 and is moved from the phantom position to the solid position shown in FIG. 16(*b*) while keeping the linear alignment condition between the central axis L2' of the first link, central axis L3' of the second link, and central axis of the L5' of the slide member. It is noted that when the thin circular shaft 155*a* is displaced in the direction D5 shown in FIG. 15(*b*), the third link 175 connected to the thin circular shaft 155*a* is rotated in the clockwise direction D1 together with central axis L4' as shown in FIG. 145(*a*).

In this instance, the cam center L1 of the circular eccentric cam 150 is eccentrically rotated in the phase advancing direction D1 about the rotational axis L0 together with the first circular eccentric through-hole 172. Thus, the circular eccentric cam 150, inscribed in the first circular eccentric through-hole 172 and sliding therein, eccentrically rotates in the phase advancing direction D1 about the rotational axis L0. As a consequence, the phase angle of the center shaft 144 (camshaft) relative to the drive rotor 141 is advanced in the D1 direction.

On the other hand, when the second electromagnetic clutch 146 is enabled, the second control rotor 143 is rotated in the phase retarding direction D2 as shown in FIG. 14(*a*). The third link 175 eccentrically rotates in the D2 direction about the rotational axis L0 together with the fifth circular eccentric hole 177 and the central axis L4', thereby exerting a force in a quasi-radial direction of the second control rotor 102 to the slide member. The slide member 155 is displaced within the slide member guide groove 153 in a radially outward direction D6 shown in FIG. 15(*b*).

In this motion, the central axis L3' of the second link 152 connected to the slide member 155 is rotated in the phase advancing direction D1. The first link 151 is then subjected to a force exerted by the second circular eccentric hole 173, and is moved from a position shown in FIG. 16(*c*) by phantom lines to the position shown by a solid line. In this instance, the axis L1 of the circular eccentric cam 150 eccentrically rotates in the phase retarding direction D2 about the rotational axis L0 together with the first circular eccentric through-hole 172, so that the circular eccentric cam 150 inscribed in the first circular eccentric through-hole 172 is eccentrically rotated about the rotational axis L0 in the phase retarding direction D2 while sliding in the first circular eccentric through-hole 172. As a consequence, the camshaft is returned in the phase retarding direction D2 relative to the drive rotor.

Figure 17:
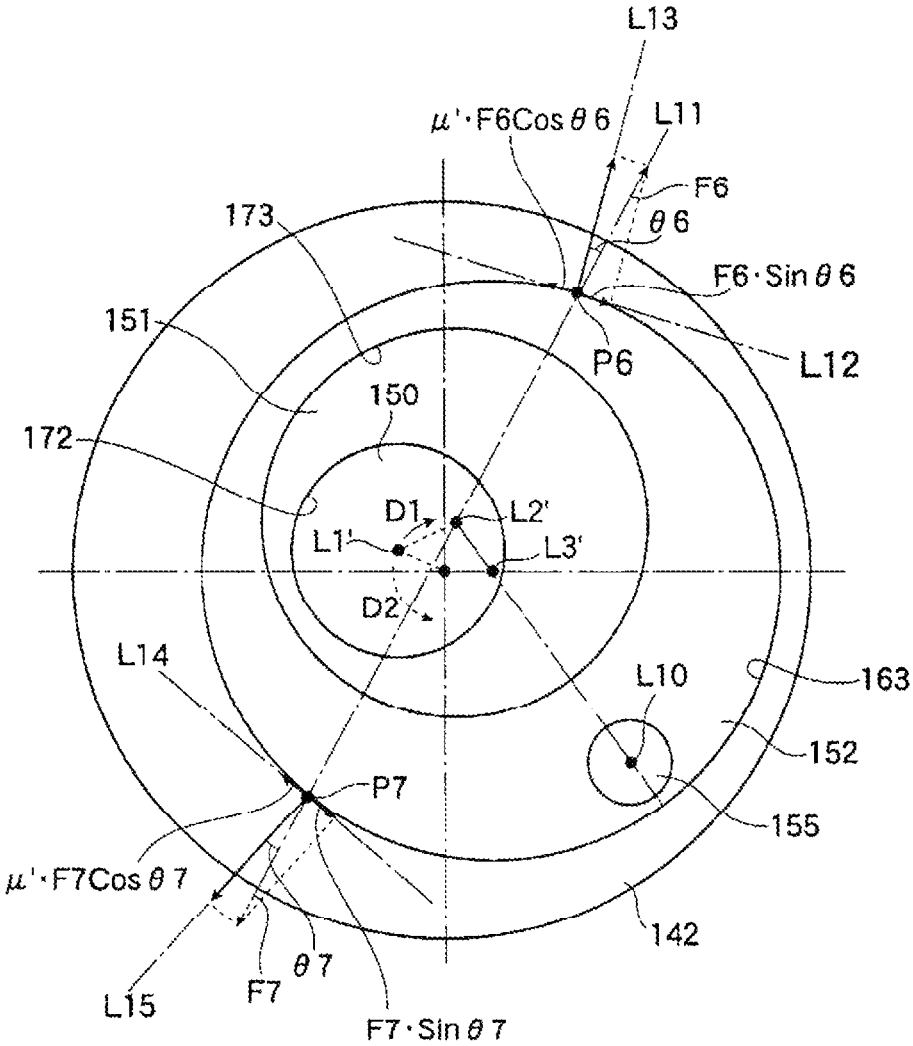
FIG. 17 illustrates the function of the self-locking mechanism of the fourth embodiment.

Next, referring to FIG. 17, there is shown a self-locking mechanism for preventing a phase gap to occur between the drive rotor 141 (crankshaft) and the center shaft 144 (camshaft) subjected to an external disturbing torque.

Since the slide member 155 is supported by the slide member guide groove 153, if an external disturbing torque is transmitted to the circular eccentric cam 150 integral with the camshaft (not shown) in the phase advancing direction, the second link 152 is acted upon by a force F6, via the wall of the first circular eccentric through-hole 172, first link 151, and the wall of the second circular eccentric hole 173, in the direction of the line L11 tangent to the trajectory of motion of the first link 151 and passing through the axis L2'. The force F6 acts on the first control rotor 142 at the point of intersection of the line L11 with the third circular eccentric hole 163. On the other hand, if an external disturbing torque is applied to the circular eccentric cam 150 in the phase retarding direction D2, the second link 152 is acted upon by a force F7 in the opposite direction along the tangent to the trajectory of the motion of the first link 151 and passing through the central axis L2' of the first link 151. The force F7 acts on the first control rotor 142 at the intersection P7 of the line L11 and the circumferential line of the third circular eccentric hole 163. These forces F6 and F7 give rise to local frictional forces between the outer periphery of the second link 152 and the third circular eccentric hole of the first control rotor 142 that prevents relative rotational motion between them.

Such local frictional force as discussed above can be given as follows. Let L12 be the line tangent to the second link 152 passing through the point P6, L13 the normal to the line L12 passing through the point P6, L14 the tangent to the second link 152 passing through the point P7, L15 the normal to the line L14 passing through P7, θ6 the angle between the lines L11 and L13, θ7 the angle between the lines L11 and L15, and μ' be the frictional coefficient of the surfaces in contact.

The force that can give rise to a phase gap between the drive rotor 141 and the camshaft is the tangential component of the frictional force at the point P7, the magnitude of which is given by F7*sin θ7. The magnitude of the local frictional force at the point P6 that prevents the slipping of the outer periphery of the second link 152 on the inner circumferential wall of the third circular eccentric hole 163, is given by μ'F6*cos θ6 and, at the point P7, is given by μ'*F7*cos θ7. When the frictional force exceeds the force that can give rise to the phase gap, the first link 111 and first control rotor 142 cannot undergo relative rotation. Accordingly, then, the first control rotor 142 and center shaft 144 will be securely locked. As a consequence, no phase gap will take place between the drive rotor 141 (crankshaft) and the center shaft 144 (camshaft). Thus, if θ6 and θ7 are chosen such that the following relationships hold, $$F6*\sin\theta6<\mu'*F6*\cos\theta6 \text{ or } \theta6<\tan^{-1}\mu'$$

$$\text{and } F7*\sin\theta7<\mu'*F7*\cos\theta7 \text{ or } \theta7<\tan^{-1}\mu'$$

the self-locking function becomes effective, preventing such phase gap caused by an external disturbing torque.

Figure 18:
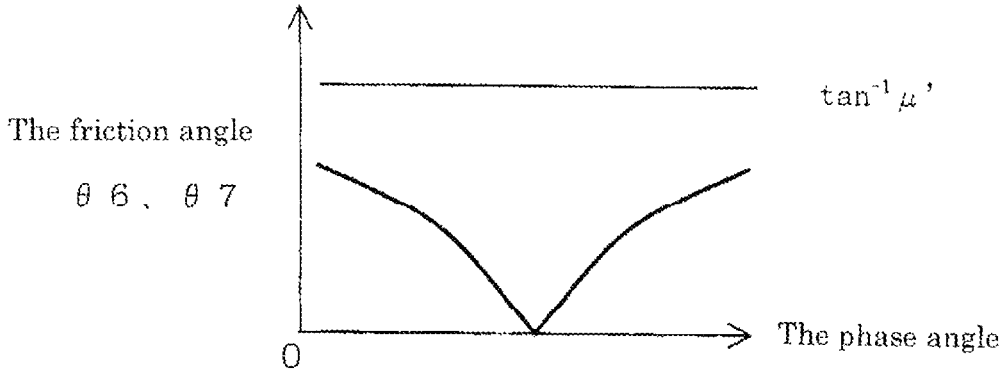
FIG. 18 shows a relationship between the friction angle and the self-locking force.

It is noted that the four-link system of the fourth embodiment is operated in an anomalistic way in that the angle between the normal to the circumference of the third circular eccentric hole 163 at P6 and the tangent to the trajectory line L11 of the first link 151 changes with the phase angle of the camshaft. Thus, the friction angle θ6 and θ7 change with the phase angle. Because of this feature, it is possible to set the friction angle θ6 and θ7 to 0 degree near the mid point of the phase varying range, as shown in FIG. 18. In this case, each of μ'*F6*cos θ6 and μ'*F7*cos θ7 becomes maximum, while F6*sin θ6 and F7*sin θ7 become 0. Thus, in the fourth embodiment, the local frictional force can be maximized near the mid point of the phase varying range for the camshaft and drive rotor.

It should be understood that each of the foregoing examples are presumably in "Phase Advancing Mode" in which the phase angle between the drive rotor and center shaft is changed in the phase advancing direction D1 upon enablement of the first electromagnetic clutch, and returned in the phase retarding direction upon enablement of the second electromagnetic clutch. However, by changing the arrangement of the four-link mechanism the apparatus can be set to "Phase Retarding Mode" in which the phase angle is changed in the phase retarding direction D2 upon enablement of the first electromagnetic clutch. It should be also understood that the second electromagnetic clutch for returning the phase angle may be replaced by an alternative return mechanism that utilizes, for example, an elastic member such as a torsion spring. It is noted that if no limitation is imposed on the angular range of rotation of the four-link system about the rotational axis L0, "Phase Advancing-Retarding Mode" can be established in which the phase angle can be changed in the phase advancing mode as well as in the phase retarding mode solely by the first electromagnetic clutch.

The invention claimed is:

1. A phase varying apparatus for use with an automobile engine including: a camshaft; a drive rotor driven by the crankshaft of the engine; a first and a second control rotor which are rotatable relative to each other and arranged coaxially between the camshaft and drive rotor; first and second torque means for respectively providing the first and second control rotor with a torque for causing a rotation relative to the drive rotor; and a phase angle varying mechanism for varying the phase angle of the camshaft relative to the drive rotor in response to the rotation of the first or second control rotor relative to the drive rotor, the phase varying apparatus characterized in that the phase angle varying mechanism comprises:

a circular eccentric cam integral with the camshaft;

a first link in the form of a substantial cylinder which is supported by the circular eccentric cam for rotation about the cam center of the circular eccentric cam;

a second link in the form of a substantial cylinder which is rotatably supported by the first link for eccentric rotation about the first axis of the first link and supported by the first control rotor for rotation about a second axis of the second link that is offset from the rotational axis of the camshaft;

a quasi-radial guide mechanism for keeping movable the first or second link in the quasi-radial direction of the respective rotor; and displacement forcing means for applying a force on, and displacing, either one of the first link and second links in the quasi-radial guide mechanism in the quasi-radial direction.

2. The phase varying apparatus according to claim 1, wherein the quasi-radial guide mechanism is a first link guide groove formed in the drive rotor to extend in a quasi-radial direction, for guiding the first link in the quasi-radial direction; and the drive rotor has a cylindrical portion for supporting the outer periphery of the first control rotor.

3. The phase varying apparatus according to claim 2, wherein a bush having a circular hole and parallel cutaway portions on the opposite sides thereof is provided between the first link and the first link guide groove;

the first link is slidably inscribed in the circular hole of the bush without touching the first link guide groove; and the cutaway portions formed on the opposite sides of the bushes are guided by the first link guide groove so that the bush is displaced along the first link guide groove together with the first link.

4. The phase varying apparatus according to claim 2, wherein the first link guide groove is inclined with respect to a radial direction of the drive rotor.

5. The phase varying apparatus according to claim 1, wherein the quasi-radial guide mechanism comprises:

slide member protruding from the second link; and a slide member guide groove in the form of a groove formed in the drive rotor to extend in a quasi-radial direction for holding the slide member movably in the quasi-radial direction;

the positions of the center axes of the first link, second link, and of the slide member with respect to the rotational axis of the center shaft are aligned with substantially the same line; and the first control rotor has a circular eccentric hole for rotatably inscribing therein the second link.

6. The phase varying apparatus according to claim 3, wherein the first link guide groove is inclined with respect to a radial direction of the drive rotor.

* * * * *